US008824715B2

(12) United States Patent
Fay et al.

(10) Patent No.: US 8,824,715 B2
(45) Date of Patent: Sep. 2, 2014

(54) OPTICAL ELECTRO-MECHANICAL HEARING DEVICES WITH COMBINED POWER AND SIGNAL ARCHITECTURES

(71) Applicant: EarLens Corporation, Redwood City, CA (US)

(72) Inventors: Jonathan P. Fay, San Mateo, CA (US); Sunil Puria, Sunnyvale, CA (US); Lee Felsenstein, Palo Alto, CA (US); James Stone, Saratoga, CA (US); Vincent Pluvinage, Atherton, CA (US)

(73) Assignee: EarLens Corporation, Redwood City, CA (US)

( * ) Notice: Subject to any disclaimer, the term of this patent is extended or adjusted under 35 U.S.C. 154(b) by 0 days.

(21) Appl. No.: 13/678,889

(22) Filed: Nov. 16, 2012

(65) Prior Publication Data

US 2013/0287239 A1 Oct. 31, 2013

Related U.S. Application Data

(62) Division of application No. 12/486,100, filed on Jun. 17, 2009, now Pat. No. 8,396,239.

(60) Provisional application No. 61/073,271, filed on Jun. 17, 2008, provisional application No. 61/139,522, filed on Dec. 19, 2008, provisional application No. 61/177,047, filed on May 11, 2009.

(51) Int. Cl.
*H04R 25/00* (2006.01)
*H04R 23/00* (2006.01)

(52) U.S. Cl.
CPC ..... *H04R 25/554* (2013.01); *H04R 25/606* (2013.01); *H04R 23/008* (2013.01)
USPC ..... 381/326; 381/312; 381/328

(58) Field of Classification Search
USPC ..... 381/312, 314, 315, 322, 323, 326, 328, 381/380, 190, 77, 79, 94.1–94.8; 600/25; 607/55, 56, 57
See application file for complete search history.

(56) References Cited

U.S. PATENT DOCUMENTS 3,229,049 A 1/1966 Hyman
3,440,314 A 4/1969 Frisch
(Continued)

FOREIGN PATENT DOCUMENTS

AU 2004-301961 A1 2/2005
DE 2044870 A1 3/1972
(Continued)

OTHER PUBLICATIONS

U.S. Appl. No. 14/185,446, filed Feb. 20, 2014, Pluvinage et al.
(Continued)

*Primary Examiner* — Huyen D Le
(74) *Attorney, Agent, or Firm* — Wilson Sonsini Goodrich & Rosati

(57) ABSTRACT

An audio signal transmission device includes a first light source and a second light source configured to emit a first wavelength of light and a second wavelength of light, respectively. The first detector and the second detector are configured to receive the first wavelength or light and the second wavelength of light respectively. A transducer electrically coupled to the detectors is configured to vibrate at least one of an eardrum or ossicle in response to the first wavelength of light and the second wavelength of light. The first detector and second detector can be coupled to the transducer with opposite polarity, such that the transducer is configured to move with a first movement in response to the first wavelength and move with a second movement in response to the second wavelength, in which the second movement opposes the first movement.

20 Claims, 13 Drawing Sheets

(56) References Cited

U.S. PATENT DOCUMENTS 3,549,818 A 12/1970 Turner et al.
3,585,416 A 6/1971 Mellen
3,594,514 A 7/1971 Wingrove
3,710,399 A 1/1973 Hurst
3,712,962 A 1/1973 Epley
3,764,748 A * 10/1973 Branch et al. ..... 607/57
3,808,179 A 4/1974 Gaylord
3,882,285 A 5/1975 Nunley et al.
3,985,977 A 10/1976 Beaty et al.
4,002,897 A 1/1977 Kleinman et al.
4,061,972 A 12/1977 Burgess
4,075,042 A 2/1978 Das
4,098,277 A 7/1978 Mendell
4,109,116 A 8/1978 Victoreen
4,120,570 A 10/1978 Gaylord
4,248,899 A 2/1981 Lyon et al.
4,252,440 A 2/1981 Frosch et al.
4,303,772 A 12/1981 Novicky
4,319,359 A 3/1982 Wolf
4,334,315 A 6/1982 Ono et al.
4,334,321 A 6/1982 Edelman
4,339,954 A 7/1982 Anson et al.
4,357,497 A 11/1982 Hochmair et al.
4,380,689 A 4/1983 Giannetti
4,428,377 A 1/1984 Zollner et al.
4,524,294 A 6/1985 Brody
4,540,761 A 9/1985 Kawamura et al.
4,556,122 A 12/1985 Goode
4,592,087 A 5/1986 Killion
4,606,329 A 8/1986 Hough
4,611,598 A 9/1986 Hortmann et al.
4,628,907 A 12/1986 Epley
4,641,377 A 2/1987 Rush et al.
4,689,819 A 8/1987 Killion
4,696,287 A 9/1987 Hortmann et al.
4,729,366 A 3/1988 Schaefer
4,741,339 A 5/1988 Harrison et al.
4,742,499 A 5/1988 Butler
4,756,312 A 7/1988 Epley
4,766,607 A 8/1988 Feldman
4,774,933 A 10/1988 Hough et al.
4,776,322 A 10/1988 Hough et al.
4,800,884 A 1/1989 Heide et al.
4,817,607 A 4/1989 Tatge
4,840,178 A 6/1989 Heide et al.
4,845,755 A 7/1989 Busch et al.
4,932,405 A 6/1990 Peeters et al.
4,936,305 A 6/1990 Ashtiani et al.
4,944,301 A 7/1990 Widin et al.
4,948,855 A 8/1990 Novicky
4,957,478 A 9/1990 Maniglia
4,999,819 A 3/1991 Newnham et al.
5,003,608 A 3/1991 Carlson
5,012,520 A 4/1991 Steeger
5,015,224 A 5/1991 Mariglia
5,015,225 A 5/1991 Hough et al.
5,031,219 A 7/1991 Ward et al.
5,061,282 A 10/1991 Jacobs
5,066,091 A 11/1991 Stoy et al.
5,094,108 A 3/1992 Kim et al.
5,117,461 A 5/1992 Moseley
5,142,186 A 8/1992 Cross et al.
5,163,957 A 11/1992 Sade et al.
5,167,235 A 12/1992 Seacord et al.
5,201,007 A 4/1993 Ward et al.
5,259,032 A 11/1993 Perkins et al.
5,272,757 A 12/1993 Scofield et al.
5,276,910 A 1/1994 Buchele
5,277,694 A 1/1994 Leysieffer et al.
5,360,388 A 11/1994 Spindel et al.
5,378,933 A 1/1995 Pfannenmueller et al.
5,402,496 A 3/1995 Soli et al.
5,411,467 A 5/1995 Hortmann et al.
5,425,104 A 6/1995 Shennib
5,440,082 A 8/1995 Claes
5,440,237 A 8/1995 Brown et al.
5,455,994 A 10/1995 Termeer et al.
5,456,654 A 10/1995 Ball
5,531,787 A 7/1996 Lesinski et al.
5,531,954 A 7/1996 Heide et al.
5,535,282 A 7/1996 Luca
5,554,096 A 9/1996 Ball
5,558,618 A 9/1996 Maniglia
5,606,621 A 2/1997 Reiter et al.
5,624,376 A 4/1997 Ball et al.
5,692,059 A 11/1997 Kruger
5,707,338 A 1/1998 Adams et al.
5,715,321 A 2/1998 Andrea et al.
5,721,783 A 2/1998 Anderson
5,729,077 A 3/1998 Newnham et al.
5,740,258 A 4/1998 Goodwin-Johansson
5,762,583 A 6/1998 Adams et al.
5,772,575 A 6/1998 Lesinski et al.
5,774,259 A 6/1998 Saitoh et al.
5,782,744 A 7/1998 Money
5,788,711 A 8/1998 Lehner et al.
5,795,287 A 8/1998 Ball et al.
5,797,834 A 8/1998 Goode
5,800,336 A 9/1998 Ball et al.
5,804,109 A 9/1998 Perkins
5,804,907 A 9/1998 Park et al.
5,814,095 A 9/1998 Muller et al.
5,825,122 A 10/1998 Givargizov et al.
5,836,863 A 11/1998 Bushek et al.
5,842,967 A 12/1998 Kroll
5,857,958 A 1/1999 Ball et al.
5,859,916 A 1/1999 Ball et al.
5,879,283 A 3/1999 Adams et al.
5,888,187 A 3/1999 Jaeger et al.
5,897,486 A 4/1999 Ball et al.
5,899,847 A 5/1999 Adams et al.
5,900,274 A 5/1999 Chatterjee et al.
5,906,635 A 5/1999 Maniglia
5,913,815 A 6/1999 Ball et al.
5,940,519 A 8/1999 Kuo
5,949,895 A 9/1999 Ball et al.
5,987,146 A 11/1999 Pluvinage et al.
6,005,955 A 12/1999 Kroll et al.
6,024,717 A 2/2000 Ball et al.
6,045,528 A 4/2000 Arenberg et al.
6,050,933 A 4/2000 Bushek et al.
6,068,589 A 5/2000 Neukermans
6,068,590 A 5/2000 Brisken
6,084,975 A 7/2000 Perkins
6,093,144 A 7/2000 Jaeger et al.
6,135,612 A 10/2000 Clore
6,137,889 A 10/2000 Shennib et al.
6,139,488 A 10/2000 Ball
6,153,966 A 11/2000 Neukermans
6,174,278 B1 1/2001 Jaeger et al.
6,181,801 B1 1/2001 Puthuff et al.
6,190,305 B1 2/2001 Ball et al.
6,190,306 B1 2/2001 Kennedy
6,208,445 B1 3/2001 Reime
6,217,508 B1 4/2001 Ball et al.
6,222,302 B1 4/2001 Imada et al.
6,222,927 B1 4/2001 Feng et al.
6,240,192 B1 5/2001 Brennan et al.
6,241,767 B1 6/2001 Stennert et al.
6,261,224 B1 7/2001 Adams et al.
6,277,148 B1 8/2001 Dormer
6,312,959 B1 11/2001 Datskos
6,339,648 B1 1/2002 McIntosh et al.
6,354,990 B1 3/2002 Juneau et al.
6,366,863 B1 4/2002 Bye et al.
6,385,363 B1 5/2002 Rajic et al.
6,387,039 B1 5/2002 Moses
6,393,130 B1 5/2002 Stonikas et al.
6,422,991 B1 7/2002 Jaeger
6,432,248 B1 8/2002 Popp et al.
6,436,028 B1 8/2002 Dormer
6,438,244 B1 8/2002 Juneau et al.
6,445,799 B1 9/2002 Taenzer et al.
6,473,512 B1 10/2002 Juneau et al.

(56) References Cited

U.S. PATENT DOCUMENTS

| | | | | |
|---|---|---|---|---|
| 6,475,134 | B1 | 11/2002 | Ball et al. | |
| 6,493,454 | B1 | 12/2002 | Loi et al. | |
| 6,519,376 | B2 | 2/2003 | Biagi et al. | |
| 6,536,530 | B2 | 3/2003 | Schultz et al. | |
| 6,537,200 | B2 | 3/2003 | Leysieffer et al. | |
| 6,549,633 | B1 | 4/2003 | Westermann | |
| 6,554,761 | B1 | 4/2003 | Puria et al. | |
| 6,575,894 | B2 | 6/2003 | Leysieffer et al. | |
| 6,592,513 | B1 | 7/2003 | Kroll et al. | |
| 6,603,860 | B1 | 8/2003 | Taenzer et al. | |
| 6,620,110 | B2 | 9/2003 | Schmid | |
| 6,626,822 | B1 | 9/2003 | Jaeger et al. | |
| 6,629,922 | B1 | 10/2003 | Puria et al. | |
| 6,668,062 | B1 | 12/2003 | Luo et al. | |
| 6,676,592 | B2 | 1/2004 | Ball et al. | |
| 6,695,943 | B2 | 2/2004 | Desporte et al. | |
| 6,724,902 | B1 | 4/2004 | Shennib et al. | |
| 6,728,024 | B2 | 4/2004 | Ribak | |
| 6,735,318 | B2 | 5/2004 | Cho | |
| 6,754,358 | B1 | 6/2004 | Boeson et al. | |
| 6,801,629 | B2 | 10/2004 | Brimhall et al. | |
| 6,829,363 | B2 | 12/2004 | Sacha | |
| 6,842,647 | B1 | 1/2005 | Faltys et al. | |
| 6,888,949 | B1 | 5/2005 | Vanden Berghe et al. | |
| 6,900,926 | B2 | 5/2005 | Ribak | |
| 6,912,289 | B2 | 6/2005 | Vonlanthen et al. | |
| 6,920,340 | B2 | 7/2005 | Laderman | |
| 6,940,989 | B1 | 9/2005 | Shennib et al. | |
| D512,979 | S | 12/2005 | Corcoran et al. | |
| 6,975,402 | B2 | 12/2005 | Bisson et al. | |
| 6,978,159 | B2 | 12/2005 | Feng et al. | |
| 7,043,037 | B2 | 5/2006 | Lichtblau | |
| 7,050,675 | B2 | 5/2006 | Zhou | |
| 7,072,475 | B1 | 7/2006 | DeNap et al. | |
| 7,076,076 | B2 | 7/2006 | Bauman | |
| 7,095,981 | B1 | 8/2006 | Voroba et al. | |
| 7,167,572 | B1 | 1/2007 | Harrison et al. | |
| 7,174,026 | B2 | 2/2007 | Niederdrank | |
| 7,203,331 | B2 | 4/2007 | Boesen | |
| 7,239,069 | B2 | 7/2007 | Cho | |
| 7,245,732 | B2 | 7/2007 | Jorgensen et al. | |
| 7,255,457 | B2 | 8/2007 | Ducharme et al. | |
| 7,266,208 | B2 | 9/2007 | Charvin et al. | |
| 7,289,639 | B2 * | 10/2007 | Abel et al. | 381/312 |
| 7,322,930 | B2 | 1/2008 | Jaeger et al. | |
| 7,376,563 | B2 | 5/2008 | Leysieffer et al. | |
| 7,421,087 | B2 | 9/2008 | Perkins et al. | |
| 7,444,877 | B2 | 11/2008 | Li et al. | |
| 7,668,325 | B2 | 2/2010 | Puria et al. | |
| 7,747,295 | B2 | 6/2010 | Choi | |
| 7,867,160 | B2 * | 1/2011 | Pluvinage et al. | 600/25 |
| 8,233,651 | B1 | 7/2012 | Haller | |
| 8,295,523 | B2 | 10/2012 | Fay et al. | |
| 8,396,239 | B2 | 3/2013 | Fay et al. | |
| 8,401,212 | B2 | 3/2013 | Puria et al. | |
| 8,696,541 | B2 | 4/2014 | Pluvinage et al. | |
| 8,715,152 | B2 | 5/2014 | Puria et al. | |
| 2001/0024507 | A1 | 9/2001 | Boesen | |
| 2001/0027342 | A1 | 10/2001 | Dormer | |
| 2002/0012438 | A1 | 1/2002 | Leysieffer et al. | |
| 2002/0030871 | A1 | 3/2002 | Anderson et al. | |
| 2002/0086715 | A1 | 7/2002 | Sahagen | |
| 2002/0172350 | A1 | 11/2002 | Edwards et al. | |
| 2002/0183587 | A1 | 12/2002 | Dormer | |
| 2003/0064746 | A1 | 4/2003 | Rader et al. | |
| 2003/0081803 | A1 | 5/2003 | Petilli et al. | |
| 2003/0125602 | A1 | 7/2003 | Sokolich et al. | |
| 2003/0142841 | A1 | 7/2003 | Wiegand | |
| 2003/0208099 | A1 | 11/2003 | Ball | |
| 2004/0165742 | A1 | 8/2004 | Shennib et al. | |
| 2004/0202340 | A1 | 10/2004 | Armstrong et al. | |
| 2004/0208333 | A1 | 10/2004 | Cheung et al. | |
| 2004/0234089 | A1 | 11/2004 | Rembrand et al. | |
| 2004/0234092 | A1 | 11/2004 | Wada et al. | |
| 2004/0240691 | A1 | 12/2004 | Grafenberg | |
| 2005/0020873 | A1 | 1/2005 | Berrang et al. | |
| 2005/0036639 | A1 | 2/2005 | Bachler et al. | |
| 2005/0163333 | A1 | 7/2005 | Abel et al. | |
| 2005/0226446 | A1 | 10/2005 | Luo et al. | |
| 2006/0023908 | A1 | 2/2006 | Perkins et al. | |
| 2006/0062420 | A1 | 3/2006 | Araki | |
| 2006/0107744 | A1 | 5/2006 | Li et al. | |
| 2006/0177079 | A1 | 8/2006 | Baekgaard Jensen et al. | |
| 2006/0189841 | A1 | 8/2006 | Pluvinage et al. | |
| 2006/0233398 | A1 | 10/2006 | Husung | |
| 2006/0247735 | A1 | 11/2006 | Honert | |
| 2006/0251278 | A1 | 11/2006 | Puria et al. | |
| 2007/0083078 | A1 | 4/2007 | Easter et al. | |
| 2007/0100197 | A1 | 5/2007 | Perkins et al. | |
| 2007/0127748 | A1 | 6/2007 | Carlile et al. | |
| 2007/0127766 | A1 | 6/2007 | Combest | |
| 2007/0135870 | A1 | 6/2007 | Shanks et al. | |
| 2007/0191673 | A1 | 8/2007 | Ball et al. | |
| 2007/0236704 | A1 | 10/2007 | Carr | |
| 2007/0250119 | A1 | 10/2007 | Tyler et al. | |
| 2007/0286429 | A1 | 12/2007 | Grafenberg et al. | |
| 2008/0021518 | A1 | 1/2008 | Hochmair et al. | |
| 2008/0051623 | A1 | 2/2008 | Schneider et al. | |
| 2008/0107292 | A1 | 5/2008 | Kornagel | |
| 2009/0092271 | A1 | 4/2009 | Fay et al. | |
| 2009/0097681 | A1 | 4/2009 | Puria et al. | |
| 2009/0310805 | A1 | 12/2009 | Petroff | |
| 2010/0034409 | A1 | 2/2010 | Fay et al. | |
| 2010/0048982 | A1 | 2/2010 | Puria et al. | |
| 2010/0202645 | A1 | 8/2010 | Puria et al. | |
| 2011/0077453 | A1 | 3/2011 | Pluvinage et al. | |

FOREIGN PATENT DOCUMENTS

| | | | |
|---|---|---|---|
| DE | 3243850 | A1 | 5/1984 |
| DE | 3508830 | A1 | 9/1986 |
| EP | 0296092 | A2 | 12/1988 |
| EP | 0296092 | A3 | 8/1989 |
| EP | 1845919 | A1 | 10/2007 |
| FR | 2455820 | A1 | 11/1980 |
| JP | 60-154800 | A | 8/1985 |
| JP | 2004-187953 | A | 7/2004 |
| WO | WO 96/21334 | A1 | 7/1996 |
| WO | WO 97/45074 | A1 | 12/1997 |
| WO | WO 99/03146 | A1 | 1/1999 |
| WO | WO 99/15111 | A1 | 4/1999 |
| WO | WO 01/50815 | A1 | 7/2001 |
| WO | WO 01/58206 | A2 | 8/2001 |
| WO | WO 01/76059 | A2 | 10/2001 |
| WO | WO 01/58206 | A3 | 2/2002 |
| WO | WO 03/063542 | A2 | 7/2003 |
| WO | WO 03/063542 | A3 | 1/2004 |
| WO | WO 2004/010733 | A1 | 1/2004 |
| WO | WO 2005/015952 | A1 | 2/2005 |
| WO | WO 2005/107320 | A1 | 11/2005 |
| WO | WO 2006/037156 | A1 | 4/2006 |
| WO | WO 2006/042298 | A2 | 4/2006 |
| WO | WO 2006/075175 | A1 | 7/2006 |
| WO | WO 2006/042298 | A3 | 10/2006 |

OTHER PUBLICATIONS

U.S. Appl. No. 60/702,532, filed Jul. 25, 2005, Aljuri.
U.S. Appl. No. 61/073,271, filed Jun. 17, 2008, Felsenstein.
U.S. Appl. No. 61/073,281, filed Jun. 17, 2008, Felsenstein.
U.S. Appl. No. 61/099,087, filed Sep. 22, 2008, Rucker.
U.S. Appl. No. 13/768,825, filed Feb. 15, 2013, Puria et al.
Atasoy [Paper] Opto-acoustic Imaging. for BYM504E Biomedical Imaging Systems class at ITU. 2005. downloaded from the Internet www2.itu.edu.td-cilesiz/courses/BYM504- 2005-OA 504041413.pdf, 14 pages.
Athanassiou, et al. Laser controlled photomechanical actuation of photochromic polymers Microsystems. Rev. Adv. Mater. Sci. 2003; 5:245-251.
Ayatollahi, et al. Design and Modeling of Micromachined Condenser MEMS Loudspeaker using Permanent Magnet Neodymium—Iron—Boron (Nd—Fe—B). IEEE International Conference on Semiconductor Electronics, 2006. ICSE '06, Oct. 29, 2006-Dec. 1, 2006; 160-166.

(56) References Cited

OTHER PUBLICATIONS

Baer, et al. Effects of Low Pass Filtering on the Intelligibility of Speech in Noise for People With and Without Dead Regions at High Frequencies. J. Acost. Soc. Am 112 (3), pt. 1, (Sep. 2002), pp. 1133-1144.
Best, et al. The influence of high frequencies on speech localization. Abstract 981 (Feb. 24, 2003) from www.aro.org/abstracts/abstracts.html.
Birch, et al. Microengineered systems for the hearing impaired. IEE Colloquium on Medical Applications of Microengineering, Jan. 31, 1996; pp. 2/1-2/5.
Burkhard, et al. Anthropometric Manikin for Acoustic Research. J. Acoust. Soc. Am., vol. 58, No. 1, (Jul. 1975), pp. 214-222.
Camacho-Lopez, et al. Fast Liquid Crystal Elastomer Swims Into the Dark, Electronic Liquid Crystal Communications. Nov. 26, 2003; 9 pages total.
Carlile, et al. Spatialisation of talkers and the segregation of concurrent speech. Abstract 1264 (Feb. 24, 2004) from www.aro.org/abstracts/abstracts.html.
Cheng, et al. A Silicon Microspeaker for Hearing Instruments. Journal of Micromechanics and Microengineering 2004; 14(7):859-866.
Datskos, et al. Photoinduced and thermal stress in silicon microcantilevers. Applied Physics Letters. Oct. 19, 1998; 73(16):2319-2321.
Decraemer, et al. A method for determining three-dimensional vibration in the ear. Hearing Res., 77:19-37 (1994).
Ear. Retrieved from the Internet: http://wwwmgs.bionet.nsc.ru/mgs/gnw/trrd/thesaurus/Se/ear.html. Accessed Jun. 17, 2008.
European search report and opinion dated Jun. 12, 2009 for EP 06758467.2.
Fay, et al. Cat eardrum response mechanics. Mechanics and Computation Division. Department of Mechanical Engineering. Standford University. 2002; 10 pages total.
Fletcher. Effects of Distortion on the Individual Speech Sounds. Chapter 18, ASA Edition of Speech and Hearing in Communication, Acoust Soc.of Am. (republished in 1995) pp. 415-423.
Freyman, et al. Spatial Release from Informational Masking in Speech Recognition. J. Acost. Soc. Am., vol. 109, No. 5, pt. 1, (May 2001); 2112-2122.
Freyman, et al. The Role of Perceived Spatial Separation in the Unmasking of Speech. J. Acoust. Soc. Am., vol. 106, No. 6, (Dec. 1999); 3578-3588.
Gennum, GA3280 Preliminary Data Sheet: Voyageur TD Open Platform DSP System for Ultra Low Audio Processing, downloaded from the Internet: <<http://www.sounddesigntechnologies.com/products/pdf/37601DOC.pdf>>, Oct. 2006; 17 pages.
Gobin, et al. Comments on the physical basis of the active materials concept. Proc. SPIE 2003; 4512:84-92.
Hato, et al. Three-dimensional stapes footplate motion in human temporal bones. Audiol. Neurootol., 8:140-152 (Jan. 30, 2003).
Headphones. Wikipedia Entry, downloaded from the Internet: http://en.wikipedia.org/wiki/Headphones. Accessed Oct. 27, 2008.
Hofman, et al. Relearning Sound Localization With New Ears. Nature Neuroscience, vol. 1, No. 5, (Sep. 1998); 417-421.
International search report and written opinion dated Aug. 7, 2009 for PCT/US2009/047682.
International search report and written opinion dated Sep. 20, 2006 for PCT/US2005/036756.
International search report and written opinion dated Oct. 17, 2007 for PCT/US2006/015087.
International search report and written opinion dated Nov. 23, 2009 for PCT/US2009/047685.
International search report and written opinion dated Dec. 8, 2008 for PCT/US2008/078793.
International search report and written opinion dated Dec. 24, 2008 for PCT/US2008/079868.
Jin, et al. Speech Localization. J. Audio Eng. Soc. convention paper, presented at the AES 112th Convention, Munich, Germany, May 10-13, 2002, 13 pages total.
Killion. Myths About Hearing Noise and Directional Microphones. The Hearing Review. Feb. 2004; 11(2):14, 16, 18, 19, 72 & 73.
Killion. SNR loss: I can hear what people say but I can't understand them. The Hearing Review, 1997; 4(12):8-14.
Lee, et al. A Novel Opto-Electromagnetic Actuator Coupled to the tympanic Membrane. J Biomech. Dec. 5, 2008;41(16):3515-8. Epub Nov. 7, 2008.
Lee, et al. The optimal magnetic force for a novel actuator coupled to the tympanic membrane: a finite element analysis. Biomedical engineering: applications, basis and communications. 2007; 19(3):171-177.
Lezal. Chalcogenide glasses—survey and progress. Journal of Optoelectronics and Advanced Materials. Mar. 2003; 5(1):23-34.
Martin, et al. Utility of Monaural Spectral Cues is Enhanced in the Presence of Cues to Sound-Source Lateral Angle. JARO. 2004; 5:80-89.
Moore. Loudness perception and intensity resolution. Cochlear Hearing Loss, Chapter 4, pp. 90-115, Whurr Publishers Ltd., London (1998).
Murugasu, et al. Malleus-to-footplate versus malleus-to-stapes-head ossicular reconstruction prostheses: temporal bone pressure gain measurements and clinical audiological data. Otol Neurotol. Jul. 2005; 2694):572-582.
Musicant, et al. Direction-Dependent Spectral Properties of Cat External Ear: New Data and Cross-Species Comparisons. J. Acostic. Soc. Am, May 10-13, 2002, vol. 87, No. 2, (Feb. 1990), pp. 757-781.
National Semiconductor, LM4673 Boomer: Filterless, 2.65W, Mono, Class D Audio Power Amplifier, [Data Sheet] downloaded from the Internet: <<http://www.national.com/ds/LM/LM4673.pdf>>; Nov. 1, 2007; 24 pages.
Poosanaas, et al. Influence of sample thickness on the performance of photostrictive ceramics, J. App. Phys. Aug. 1, 1998; 84(3):1508-1512.
Puria et al. A gear in the middle ear. ARO Denver CO, 2007b.
Puria, et al. Malleus-to-footplate ossicular reconstruction prosthesis positioning: cochleovestibular pressure optimization. Otol. Nerotol. May 2005; 2693):368-379.
Puria, et al. Measurements and model of the cat middle ear: Evidence of tympanic membrane acoustic delay. J. Acoust. Soc. Am., 104(6):3463-3481 (Dec. 1998).
Puria, et al. Middle Ear Morphometry From Cadaveric Temporal Bone MicroCT Imaging. Proceedings of the 4th International Symposium, Zurich, Switzerland, Jul. 27-30, 2006, Middle Ear Mechanics in Research and Otology, pp. 259-268.
Puria, et al. Sound-Pressure Measurements in the Cochlear Vestibule of Human-Cadaver Ears. Journal of the Acoustical Society of America. 1997; 101 (5-1): 2754-2770.
Sekaric, et al. Nanomechanical resonant structures as tunable passive modulators. App. Phys. Left. Nov. 2003; 80(19):3617-3619.
Shaw. Transformation of Sound Pressure Level From the Free Field to the Eardrum in the Horizontal Plane. J. Acoust. Soc. Am., vol. 56, No. 6, (Dec. 1974), 1848-1861.
Shih. Shape and displacement control of beams with various boundary conditions via photostrictive optical actuators. Proc. IMECE. Nov. 2003; 1-10.
Sound Design Technologies,—Voyager TDTM Open Platform DSP System for Ultra Low Power Audio Processing—GA3280 Data Sheet. Oct. 2007; retrieved from the Internet: <<http://www.sound-des.com/pdf/37601DOC.pdf>>, 15 page total.
Stuchlik, et al. Micro-Nano actuators driven by polarized light. IEE Proc. Sci. Meas. Techn. Mar. 2004; 151(2):131-136.
Suski, et al. Optically activated ZnO/Si02/Si cantilever beams. Sensors and Actuators A (Physical), 0 (nr: 24). 2003; 221-225.
Takagi, et al. Mechanochemical Synthesis of Piezoelectric PLZT Powder. KONA. 2003; 51(21):234-241.
Thakoor, et al. Optical microactuation in piezoceramics. Proc. SPIE. Jul. 1998; 3328:376-391.
Thompson. Tutorial on microphone technologies for directional hearing aids. Hearing Journal. Nov. 2003; 56(11):14-16,18, 20-21.

(56) References Cited

OTHER PUBLICATIONS

Tzou, et al. Smart Materials, Precision Sensors/Actuators, Smart Structures, and Structronic Systems. Mechanics of Advanced Materials and Structures. 2004; 11:367-393.
Uchino, et al. Photostricitve actuators. Ferroelectrics. 2001; 258:147-158.
Vickers, et al. Effects of Low-Pass Filtering on the Intelligibility of Speech in Quiet for People With and Without Dead Regions at High Frequencies. J. Acoust. Soc. Am., vol. 110, No. 2, (Aug. 2001), pp. 1164-1175.
Wang, et al. Preliminary Assessment of Remote Photoelectric Excitation of an Actuator for a Hearing Implant. Proceeding of the 2005 IEEE, Engineering in Medicine and Biology 27th nnual Conference, Shanghai, China. Sep. 1-4, 2005; 6233-6234.
Wiener, et al. On the Sound Pressure Transformation by the Head and Auditory Meatus of the Cat. Acta Otolaryngol. Mar. 1966; 61(3):255-269.
Wightman, et al. Monaural Sound Localization Revisited. J Acoust Soc Am. Feb. 1997;101(2):1050-1063.
Yi, et al. Piezoelectric Microspeaker with Compressive Nitride Diaphragm. The Fifteenth IEEE International Conference on Micro Electro Mechanical Systems, 2002; 260-263.
Yu, et al. Photomechanics: Directed bending of a polymer film by light. Nature. Sep. 2003; 425:145.
European search report and opinion dated Feb. 6, 2013 for EP Application No. 09767670.
U.S. Appl. No. 14/219,076, filed Mar. 19, 2014, Puria et al.

* cited by examiner

OPTICAL ELECTRO-MECHANICAL HEARING DEVICES WITH COMBINED POWER AND SIGNAL ARCHITECTURES

CROSS-REFERENCE TO RELATED APPLICATIONS

This application is a divisional of U.S. Ser. No. 12/486,100 filed Jun. 17, 2009, which claims the benefit under 35 USC 119(e) of U.S. Provisional Application Nos. 61/073,271 filed Jun. 17, 2008, 61/139,522 filed Dec. 19, 2008, and 61/177,047 filed May 11, 2009; the full disclosures of which are incorporated herein by reference in their entirety.

The subject matter of the present application is related to the following provisional applications: 61/073,281, entitled "OPTICAL ELECTRO-MECHANICAL HEARING DEVICES WITH SEPARATE POWER AND SIGNAL COMPONENTS", filed on Jun. 17, 2008; 61/139,520, entitled "OPTICAL ELECTRO-MECHANICAL HEARING DEVICES WITH SEPARATE POWER AND SIGNAL COMPONENTS", filed on Dec. 19, 2008; the full disclosures of which are incorporated herein by reference and suitable for combination in accordance with embodiments of the present invention.

BACKGROUND OF THE INVENTION

1. Field of the Invention

The present invention is related to hearing systems, devices and methods. Although specific reference is made to hearing aid systems, embodiments of the present invention can be used in many applications where tissue is stimulated with at least one of vibration or an electrical current, for example with wireless communication, the treatment of neurological disorders such as Parkinson's, and cochlear implants.

People like to hear. Hearing devices can be used with communication systems and aids to help the hearing impaired. Hearing impaired subjects need hearing aids to verbally communicate with those around them. Open canal hearing aids have proven to be successful in the marketplace because of increased comfort and an improved cosmetic appearance. Another reason why open canal hearing aides can be popular is reduced occlusion of the ear canal. Occlusion can result in an unnatural, tunnel-like hearing effect which can be caused by large hearing aids which block the ear canal. However, a problem that may occur with open canal hearing aids is feedback. The feedback may result from placement of the microphone in too close proximity with the speaker or the amplified sound being too great. Thus, feedback can limit the degree of sound amplification that a hearing aid can provide. In some instances, feedback may be minimized by using non-acoustic means of stimulating the natural hearing transduction pathway, for example stimulating the tympanic membrane and/or bones of the ossicular chain. A permanent magnet or plurality of magnets may be coupled to the eardrum or the ossicles in the middle ear to stimulate the hearing pathway. These permanent magnets can be magnetically driven to cause motion in the hearing transduction pathway thereby causing neural impulses leading to the sensation of hearing. A permanent magnet may be coupled to the eardrum through the use of a fluid and surface tension, for example as described in U.S. Pat. Nos. 5,259,032 and 6,084,975.

However, work in relation to embodiments of the present invention suggests that magnetically driving the hearing transduction pathway may have limitations. The strength of the magnetic field generated to drive the attached magnet may decrease rapidly with the distance from the field generator coil to the permanent magnet. For magnets implanted to the ossicle, invasive surgery may be needed. Coupling a magnet to the eardrum may avoid the need for invasive surgery. However, there can be a need to align the driver coil with the permanent magnet, and placement of the driver coil near the magnet can cause discomfort for the user, in at least some instances.

An alternative approach is a photo-mechanical system. For example, a hearing device may use light as a medium to transmit sound signals. Such systems are described in U.S. Pat. No. 7,289,639 and U.S. Publication No. 2006/0189841. The optical output signal can be delivered to an output transducer coupled to the eardrum or the ossicle. Although optical systems may result in improved comfort for the patient, work in relation to embodiments of the present invention suggests that such systems may result in at least some distortion of the signal such that in some instances the sound perceived by the patient may be less than ideal.

Although pulse width modulation can be used to transmit an audio signal with an optical signal, work in relation to embodiments of the present invention suggests that at least some of the known pulse width modulation schemes may not work well with compact hearing devices, in at least some instances. Work in relation to embodiments of the present invention suggests that at least some of the known pulse width modulation schemes can result in noise perceived by the user in at least some instances. Further, some of the known pulse width modulation approaches may use more power than is ideal, and may rely on active circuitry and power storage to drive the transducer in at least some instances. A digital signal output can be represented by a train of digital pulses. The pulses can have a duty cycle (the ratio of active time to the overall period) that varies with the intended analog amplitude level. The pulses can be integrated to find the intended audio signal, which has an amplitude equal to the duty cycle multiplied by the pulse amplitude. When the amplitude of the intended audio signal decreases, the duty cycle can be decreased so that the amplitude of the integrated audio signal drops proportionally. Conversely, when the amplitude of the intended audio signal increases, the duty cycle can be increased so that the amplitude rises proportionally. Analog audio signals may vary positively or negatively from zero. At least some known pulse width modulation schemes may use a quiescent level, or zero audio level, represented by a 50% duty cycle. Decreases in duty cycle from this quiescent level can correspond to negative audio signal amplitude while increases in duty cycle can correspond to positive audio signal amplitude. Because this quiescent level is maintained, significant amounts of power may be consumed. While this amount of power use may not be a problem for larger signal transduction systems, it can pose problems for at least some hearing devices in at least some instances, which are preferably small and may use batteries that are infrequently replaced.

For the above reasons, it would be desirable to provide hearing systems which at least decrease, or even avoid, at least some of the above mentioned limitations of the current hearing devices. For example, there is a need to provide a comfortable hearing device with less distortion and less feedback than current devices.

2. Description of the Background Art

Patents that may be interest include: U.S. Pat. Nos. 3,585,416, 3,764,748, 5,142,186, 5,554,096, 5,624,376, 5,795,287, 5,800,336, 5,825,122, 5,857,958, 5,859,916, 5,888,187, 5,897,486, 5,913,815, 5,949,895, 6,093,144, 6,139,488, 6,174,278, 6,190,305, 6,208,445, 6,217,508, 6,222,302, 6,422,991, 6,475,134, 6,519,376, 6,626,822, 6,676,592, 6,728,024, 6,735,318, 6,900,926, 6,920,340, 7,072,475, 7,095,981, 7,239,069, 7,289,639, D512,979, and EP1845919. Patent publications of potential interest include: PCT Publication Nos. WO 03/063542, WO 2006/075175, U.S. Publication Nos. 2002/0086715, 2003/0142841, 2004/0234092, 2006/0107744, 2006/0233398, 2006/075175, 2008/0021518, and 2008/0107292. Publications and patents also of potential interest include U.S. Pat. Nos. 5,259,032, 5,276,910, 5,425,104, 5,804,109, 6,084,975, 6,554,761, 6,629,922, U.S. Publication Nos. 2006/0023908, 2006/0189841, 2006/0251278, and 2007/0100197. Journal publications that may be interest include: Ayatollahi et al., "Design and Modeling of Micromachines Condenser MEMS Loudspeaker using Permanent Magnet Neodymium-Iron-Boron (Nd—Fe—B)", ISCE, Kuala Lampur, 2006; Birch et al, "Microengineered Systems for the Hearing Impaired", IEE, London, 1996; Cheng et al., "A silicon microspeaker for hearing instruments", J. Micromech. Microeng., 14(2004) 859-866; Yi et al., "Piezoelectric microspeaker with compressive nitride diaphragm", IEEE, 2006, and Zhigang Wang et al., "Preliminary Assessment of Remote Photoelectric Excitation of an Actuator for a Hearing Implant", IEEE Engineering in Medicine and Biology 27th Annual Conference, Shanghai, China, Sep. 1-4, 2005. Other publications of interest include: Gennum GA3280 Preliminary Data Sheet, "Voyager TDTM.Open Platform DSP System for Ultra Low Power Audio Processing" and National Semiconductor LM4673 Data Sheet, "LM4673 Filterless, 2.65W, Mono, Class D audio Power Amplifier"; and Lee et al., "The Optimal Magnetic Force For A Novel Actuator Coupled to the Tympanic Membrane: A Finite Element Analysis," Biomedical Engineering: Applications, Basis and Communications, Vol. 19, No. 3(171-177), 2007.

SUMMARY OF THE INVENTION

The present invention is related to hearing systems, devices and methods. Embodiments of the present invention can provide improved audio signal transmission which overcomes at least some of the aforementioned limitations of current systems. The systems, devices, and methods described herein may find application for hearing devices, for example open ear canal hearing aides. An audio signal transmission device may include a first light source and a second light source configured to emit a first wavelength of light and a second wavelength of light, respectively. The first detector can be configured to receive the first wavelength of light and the second detector can be configured to receive the second wavelength of light. A transducer can be electrically coupled to the first detector and the second detector and configured to vibrate at least one of an eardrum, ossicle, or a cochlea in response to the first wavelength of light and the second wavelength of light. Coupling of the transducer to the first detector and the second detector can provide quality sound perceived by the user, for example without active electronic components to drive the transducer, such that the size of the transducer assembly can be minimized and suitable for placement on at least one of a tympanic membrane, an ossicle or the cochlea. In some embodiments, the first detector and the second detector can be coupled to the transducer with opposite polarity, such that the transducer is configured to move with a first movement in response to the first wavelength and move with a second movement in response to the second wavelength, in which the second movement opposes the first movement. The first detector may be positioned over the second detector and transmit the second wavelength to the second detector, such that a cross sectional size of the detectors in the ear canal can be decreased and energy transmission efficiency increased. In many embodiments, the first movement comprises at least one of a first rotation or a first translation, and the second movement comprises at least one of a second rotation or a second translation. In specific embodiments, the first detector can be coupled to a coil to translate a magnet in a first direction in response to the first wavelength, and the second detector can be coupled to the coil induce a second translation of the magnet in a second direction in response to the second wavelength, in which the second translation in the second direction is opposite the first translation in the first direction. Circuitry may be configured to separate the audio signal into a first signal component and a second signal component, and the first light source can emit the first wavelength in response to the first signal component and the second light source can emit the second wavelength in response to the second signal. For example, the circuitry can be configured to transmit the first signal component to the first light source with a first pulse width modulation and the second signal component to the second light source with a second pulse width modulation, which can decrease distortion perceived by the user. In some embodiments, the first signal and second signal are configured such the light source is off when the second light source is on and vice versa, such that energy efficiency can be improved. Audio signal transmission using the first and second light sources coupled to the first and second detectors, respectively, as described herein, can decrease power consumption, provide a high fidelity audio signal to the user, and improve user comfort with optical coupling. The amplitude and timing of the first light source relative to the second light source can be adjusted so as to decrease noise related to differences in response times and differences in light sensitivities of the detectors of the transducer assembly for each the first wavelength and the second wavelength, such that the user can perceive clear sound with low noise, increased gain, for example up to 6 dB or more, and low power consumption. The first photo detector may be positioned over the second photo detector, in which the first photo detector is configured to transmit the second at least one wavelength to the second photo detector, such that the first and second wavelengths can be efficiently coupled to the first and second photodetectors, respectively.

In a first aspect, a device for transmitting an audio signal to a user is provided, in which the device comprises a first light source, a second light source, a first detector, a second detector, and a transducer. The first light source is configured to emit a first at least one wavelength of light. The second light source is configured to emit a second at least one wavelength of light. The first detector is configured to receive the first at least one wavelength of light. The second detector is configured to receive the second at least one wavelength of light. The transducer is electrically coupled to first and second detectors and is configured to vibrate at least one of an eardrum, an ossicle, or a cochlea of the user in response to the first at least one wavelength and the second at least one wavelength.

In many embodiments, the first light source and the first detector are configured to move the transducer with a first movement and the second light source and the second detector are configured to move the transducer with a second movement. The first movement can be opposite the second movement. The first movement may each comprise at least one of a first rotation or a first translation, and the second movement may comprise at least one of a second rotation or a second translation. The first light source may be configured to emit the first at least one wavelength of light with a first amount of energy, which first amount is sufficient to move the transducer with the first movement. The second light source can be configured to emit the second at least one wavelength of light with a second amount of light energy, which second amount is sufficient to move the transducer with the second movement.

In many embodiments, the transducer is supported with the eardrum of the user. The transducer can be configured to move the eardrum in a first direction in response to the first at least one wavelength and to move the eardrum in a second direction in response to the second at least one wavelength. The first direction can be opposite the second direction.

In many embodiments, the first detector and the second detector are connected to the transducer to drive the transducer without active circuitry.

The first detector and the second detector may be connected in parallel to the transducer. The first detector may be coupled to the transducer with a first polarity and the second detector coupled with the transducer with a second polarity, in which the second polarity is opposite to the first polarity. In some embodiments, the first detector comprises a first photodiode having a first anode and a first cathode and the second detector comprises a second photodiode having a second anode and a second cathode. The first anode and the second cathode may be connected to a first terminal of the transducer, and the second anode and the second cathode may be connected to a second terminal of the transducer.

The transducer may comprise at least one of a piezoelectric transducer, a flex tensional transducer, a balanced armature transducer, or a magnet and wire coil. For example, the transducer may comprise the balanced armature transducer and the balanced armature transducer may comprise a housing.

In many embodiments, the first light source comprises at least one of a first LED or a first laser diode configured to emit the first at least one wavelength of light and the second light source comprises at least one of a second LED or second laser diode configured to emit the second at least one wavelength of light.

In many embodiments, the first detector comprises at least one of a first photodiode or a first photovoltaic cell configured to receive the first at least one wavelength of light and the second detector comprises at least one of a second photodiode or a second photovoltaic cell configured to receive the second at least one wavelength of light.

In many embodiments, the first detector comprises at least one of crystalline silicon, amorphous silicon, micromorphous silicon, black silicon, cadmium telluride, copper indium or gallium selenide, and the second detector comprises at least one crystalline silicon, amorphous silicon, micromorphous silicon, black silicon, cadmium telluride, copper indium or gallium selenide.

The first at least one wavelength of light from the first light source may be configured to overlap spatially with the second at least one wavelength of light from the second light source as the light travels in an ear canal of a user toward the first and second detectors. The first at least one wavelength and second at least one wavelength of light can be different, and may comprise at least one of infrared, visible or ultraviolet light.

In many embodiments, the device further comprises a first optical filter positioned along a first optical path extending from the first light source to the first detector. The first optical filter may be configured to separate the first at least one wavelength of light from the second at least one wavelength of light. The device may sometimes further comprise a second optical filter positioned along a second optical path extending from the second light source to the second detector, and the second detector can be configured to transmit the second at least one wavelength.

In another aspect, embodiments of the present invention provide a hearing system to transmit an audio signal to a user, in which the hearing system comprises a microphone, circuitry, a first light source, a second light source, a first detector, a second detector, and a transducer. The microphone is configured to receive the audio signal. The circuitry is configured to separate the audio signal into a first signal component and a second signal component. The first light source is coupled to the circuitry to transmit the first signal component at a first at least one wavelength of light. The second light source is coupled to the circuitry to transmit the second signal component a second at least one wavelength of light. The first detector is coupled to the first light source to receive the first signal component with the first at least one wavelength of light. The second detector is coupled to the second light source to receive the second signal component with the second at least one wavelength of light. The transducer is coupled to the first detector and the second detector and configured to vibrate at least one of an eardrum or an ossicle in response to the first signal component and the second signal component.

In many embodiments, the first light source and the first detector are configured to move the transducer with a first movement, and the second light source and the second detector are configured to move the transducer with a second movement, in which the first movement is opposite the second movement.

The circuitry may be configured to emit the first at least one wavelength from the first light source when the second at least one wavelength is not emitted from the second light source. The circuitry may be configured to emit the second at least one wavelength from the second light source when the first at least one wavelength is not emitted from the first light source.

In many embodiments, the circuitry is configured to transmit the first signal component to the first light source with a first pulse width modulation and the second signal component to the second light source with a second pulse width modulation. The first pulse width modulations may comprise a first series of first pulses. The second pulse width modulation may comprise a second series of second pulses. In many embodiments, the first pulses may be separated temporally from the second pulses such that the first pulses do not overlap with the second pulses. Alternatively or in combination, the first series of first pulses and the second series of second pulses comprise at least some pulses that overlap. The first pulse width modulation may comprise at least one of a dual differential delta sigma pulse with modulation or a delta sigma pulse width modulation. The second pulse width modulation may comprise at least one of a dual differential delta sigma pulse width modulation or a delta sigma pulse width modulation.

In many embodiments, the circuitry is configured to compensate for a non-linearity of at least one of the first light source, the second light source, the first detector, the second detector or the transducer. The non-linearity may comprise at least one of a light emission intensity threshold of the first light source or an integration time and/or capacitance of the first detector.

In a further aspect, embodiments of the present invention provide a method for transmitting an audio signal to a user. A first light source emits a first at least one wavelength of light and a second light source emits a second at least one wavelength of light. A first detector detects the first at least one wavelength of light and a second detector detects the second at least one wavelength of light. At least one of an eardrum, an ossicle, or a cochlea of the user is vibrated with a transducer electrically coupled to the first detector and the second detector in response to the first at least one wavelength and the second at least one wavelength.

In many embodiments, the transducer moves with a first movement in response to the first at least one wavelength and a second movement in response to the second at least one wavelength. The first movement is opposite the second movement. The first movement may comprise at least one of a first rotation or a first translation. The second movement may comprise at least one of a second rotation or a second translation. The first at least one wavelength of light may comprise a first amount of energy sufficient to move the transducer with the first movement. The second at least one wavelength of light may comprise a second amount of light energy sufficient to move the transducer with the second movement.

In many embodiments, the transducer is supported with the eardrum of the user and moves the eardrum in a first direction in response to the first at least one wavelength and moves the eardrum in a second direction in response to the second at least one wavelength.

In many embodiments, the audio signal is separated into a first signal component and a second signal component. The first light source is driven with the first signal component and the second light source is driven with the second signal component. The first signal may be transmitted to the first light source with a first pulse width modulation and the second signal may be transmitted to the second light source with a second pulse width modulation. Sometimes, the first pulse width modulation may comprise a first series composed of first pulses and the second pulse width modulation comprises a second series composed of second pulses. The first pulses may be separated temporally from the second pulses such that the first pulses do not overlap with the second pulses.

In another aspect, embodiments of the present invention provide method of transmitting an audio signal to a user. At least one wavelength of light is emitted from at least one light source, in which the at least one wavelength is pulse width modulated. The at least one wavelength of light is detected with at least one detector. At least one of an eardrum, an ossicle, or a cochlea of the user is vibrated with at least one transducer electrically coupled to the at least one detector in response to the at least one wavelength.

In many embodiments, the at least one transducer is electrically coupled to the first detector without active circuitry to drive the transducer in response to the first at least one wavelength. The at least one of the eardrum, the ossicle, or the cochlea can be vibrated with energy from each pulse of the pulse width modulated first at least one wavelength.

In another aspect, embodiments of the present invention provide a device to transmit an audio signal to a user. A first light source is configured to emit at least one wavelength of light. Pulse width modulation circuitry is coupled to the at least one light source to pulse width modulate the at least one light source in response to the audio signal. At least one detector is configured to receive the at least one wavelength of light. At least one transducer is electrically coupled to the at least one detector. The at least one transducer is configured to vibrate at least one of an eardrum, an ossicle, or a cochlea of the user in response to the at least one wavelength.

In another aspect, embodiments of the present invention provide a device to transmit an audio signal to a user. A first light source is configured to emit at least one wavelength of light. Pulse width modulation circuitry is coupled to the at least one light source to pulse width modulate the at least one light source in response to the audio signal. A transducer assembly is optically coupled to the at least one light source and configured to vibrate at least one of an eardrum, an ossicle, or a cochlea of the user in response to the at least one wavelength.

In many embodiments, the transducer assembly is supported with the at least one of the eardrum, the ossicle, or the cochlea. For example, the transducer assembly can be supported with the eardrum.

In another aspect, embodiments of the present invention provide a device to transmit an audio signal to a user. A first light source is configured to emit a first at least one wavelength of light. A second light source is configured to emit a second at least one wavelength of light. A transducer assembly comprises at least one light responsive material configured to vibrate at least one of an eardrum, an ossicle, or a cochlea of the user. Circuitry is coupled to the first light source to emit first light pulses and to the second light source to emit second light pulses. The circuitry is configured to adjust at least one of an energy or a timing of the first light pulses relative to the second light pulses to decrease noise of the audio signal transmitted to the user.

In many embodiments, the circuitry is configured to adjust the at least one of the energy or the timing of the first light pulses relative to the second light pulses to increase output of the audio signal transmitted to the user when the noise is decreased.

In many embodiments, the transducer assembly is configured to move in a first direction in response to the first light pulses and move a second direction opposite the first direction in response the second light pulses.

In many embodiments, the circuitry is configured to adjust the timing of the first pulses relative to the second pulses. The transducer assembly may be configured to move in the first direction with a first delay in response to each of the first light pulses and configured to move in the second direction with a second delay in response to each of the second light pulses, in which the first delay is different from the second delay. The circuitry can be configured to adjust the timing to inhibit noise corresponding to the first delay different from the second delay. For example, the first detector may comprise a silicon detector and the second detector may comprise an InGaAs detector, such that the difference between the first delay and the second delay may be within a range from about 100 ns to about 10 us. The circuitry may comprise a buffer configured to store the first signal to delay the first signal. Alternatively or in combination, the circuitry may comprise at least one of an inductor, a capacitor or a resistor to delay the first signal.

In many embodiments, the circuitry is configured to adjust first energies of the first light pulses relative to second energies of the light second pulses to inhibit the noise. For example, the circuitry may be configured adjust a first intensity of the first pulses relative to a second intensity of the second pulses to inhibit the noise. The circuitry can be configured adjust first widths of the first pulses relative to second widths of the second pulse to inhibit the noise. The at least one transducer assembly may be configured to move in the first direction with a first gain in response to the first light pulses and configured to move in the second direction with a second gain in response the second light pulses, in which the first gain is different from the second gain. The circuitry may be configured adjust first energies of the first pulses relative to second energies of the second pulses to inhibit noise corresponding to the first gain different from the second gain.

In many embodiments, the circuitry comprises a processor comprising a tangible medium and wherein the processor coupled to the first light source to transmit first light pulses and coupled to the second light source to transmit second light pulses. The transducer assembly may be configured to move in the first direction with a first gain in response to the light first pulses and move in the second direction with a second gain in response to the second light pulses, in which the first gain is different from the second gain. The processor can be configured to adjust an energy of the first pulses to inhibit noise corresponding to the first gain different from the second gain. The tangible medium of the processor may comprise a memory having at least one buffer configured to store first data corresponding to the first light pulses and second data corresponding to the second light pulses. The processor can be configured to delay the first light pulses relative to the second light pulses to inhibit the noise.

In many embodiments, the at least one light responsive material comprises a first photo detector sensitive to the first at least one wavelength and a second photo detector sensitive to the second at least one wavelength. The first photo detector is configured to couple to the first light source to move the transducer assembly with a first efficiency, and the second detector is configured to couple to the second light source to move the transducer assembly with a second efficiency, in which the second efficiency is different from the first efficiency. The first photo detector may be positioned over the second photo detector and wherein the first photo detector is configured to transmit the second at least one wavelength to the second photo detector.

In many embodiments, the at least one light responsive material comprises a photostrictive material configured to move in the first direction in response to the first at least one wavelength and the second direction in response to the second at least one wavelength. The photostrictive material may comprise a semiconductor material having a bandgap. The first at least one wavelength may correspond to energy above the bandgap to move the photostrictive material in the first direction, and the second at least one wavelength may corresponds to energy below the bandgap to move the photostrictive material in the second direction opposite the first direction.

In many embodiments, the transducer assembly is configured for placement in at least one of an ear canal of an external ear of the user, a middle ear of the user, or at least partially within an inner ear of the user. For example, transducer assembly can be configured for placement in an ear canal of an external ear of the user. Alternatively, the transducer assembly can be configured for placement in a middle ear of the user. The transducer assembly can be configured for placement at least partially within an inner ear of the user.

In another aspect, embodiments provide method of transmitting an audio signal to a user. First pulses comprising a first at least one wavelength of light are emitted from a first light source. Second pulses comprising a second at least one wavelength of light are emitted from a second light source. The first pulses and the second pulses are received with a transducer assembly to vibrate at least one of an eardrum, an ossicle, or a cochlea of the user. At least one of an energy or a timing of the first pulses is adjusted relative to the second pulses to decrease noise of the audio signal transmitted to the user.

In many embodiments, the circuitry adjusts the at least one of the energy or the timing of the first light pulses relative to the second light pulses to increase output of the audio signal transmitted to the user when the noise is decreased.

In many embodiments, the transducer assembly is moved in a first direction in response to the first pulses and moved in a second direction in response to the second pulses, the second direction opposite the first direction.

In many embodiments, the timing of the first pulses is adjusted relative to the second pulses. The transducer assembly may move in the first direction with a first delay in response to each of the first pulses and move in the second direction with a second delay in response to each of the second pulses, in which the second delay is different from the first delay. The timing can be adjusted to inhibit noise corresponding to the first delay different from the second delay. For example, the first detector may comprise a silicon detector and the second detector may comprise an InGaAs detector, and the difference between the first delay and the second delay can be within a range from about 100 ns to about 10 us.

In many embodiments, first energies of the first light pulses are adjusted relative to second energies of the second light pulses to inhibit the noise. A first intensity of the first pulses can be adjusted relative to a second intensity of the second pulses to inhibit the noise. For example, first widths of the first pulses can be adjusted relative to second widths of the second pulses to inhibit the noise At least one transducer assembly may move in the first direction with a first gain in response to the first pulses and may move in the second direction with a second gain in response the second pulses. The first energies of the first pulses may be adjusted relative to the second energies of the second pulse to inhibit noise corresponding to the first gain different from the second gain.

In many embodiments, a first signal comprising first pulses is transmitted to the first light source and a second signal comprising second pulses is transmitted to the second light source. The transducer assembly may move in the first direction with a first gain in response to the first pulses and may move in the second direction with a second gain in response to the second pulses, in which the first gain different from the second gain. At least one of an intensity of the first pulses or a duration of the first pulses is adjusted to compensate for the first gain different from the second gain to decrease the noise.

In many embodiments, first data corresponding to the first pulses are stored in at least one buffer to delay the first pulses. The first pulses can be delayed with at least one of a resistor, a capacitor or an inductor.

In many embodiments, the at least one light responsive material comprises a first photo detector sensitive to the first at least one wavelength and a second photo detector sensitive to the second at least one wavelength. The first photo detector may be coupled to the first light source to move the transducer assembly with a first efficiency, and the second detector may be coupled to the second light source to move the transducer assembly with a second efficiency, the second efficiency different from the first efficiency.

In many embodiments, the at least one light responsive material comprises a photostrictive material configured to move in the first direction in response to the first at least one wavelength and the second direction in response to the second at least one wavelength.

In many embodiments, the first at least one wavelength and the second at least one wavelength are transmitted at least partially along an ear canal of the user to the transducer assembly, and the transducer assembly is positioned in the ear canal of an external ear of the user.

In many embodiments, the first at least one wavelength and the second at least one wavelength are transmitted through the eardrum of the user, and the transducer assembly is positioned in a middle ear of the user. For example, the transducer assembly can be positioned in the middle ear to vibrate the ossicles.

In many embodiments, the first at least one wavelength and the second at least one wavelength are transmitted through an eardrum of the user, and the transducer assembly is positioned at least partially within an inner ear of the user. For example, the transducer assembly can be positioned at least partially within the inner ear to vibrate the cochlea.

In another aspect embodiments of the present invention provide a device to stimulate a target tissue, the device comprises a first light source configured to transmit a pulse width modulated light signal comprising a first at least one wavelength of light. A second light source is configured to transmit a second pulse width modulated light signal comprising a first at least one wavelength of light. At least one detector is coupled to the target tissue to stimulate the target tissue in response to the first pulse width modulated light signal and the second pulse width modulated signal.

In many embodiments, a first implantable detector and a second implantable detector are configured to stimulate the tissue with at least one of a vibration or a current and wherein the detector is coupled to at least one of a transducer or at least two electrodes. The first implantable detector and the second implantable detector can be configured to stimulate the tissue with the current and wherein the first implantable detector and the second implantable detector are coupled to the at least two electrodes.

In many embodiments, the target tissue comprises a cochlea of the user, and the first pulse width modulated light signal and the second pulse width modulated light signal comprise an audio signal.

In another aspect embodiments of the present invention provide a method of stimulating a target tissue. A first pulse width modulated light signal comprising at least one wavelength of light is emitted from a first at least one light source. A second pulse width modulated light signal comprising a second at least one wavelength of light is emitted from a second at least one light source. The target tissue in response to the first pulse width modulated light signal and the second pulse width modulated signal.

In many embodiments, the target tissue is stimulated with at least one of a vibration or a current. For example, the target tissue can be stimulated with the current. A first implantable detector can be coupled to at least two electrodes, and the first implantable detector can stimulate the tissue in response to the first modulated signal comprising the first at least one wavelength of light. A second implantable detector can be coupled to the at least two electrodes, and the second implantable detector can stimulate the tissue in response to the second modulated signal comprising the second at least one wavelength of light. The first implantable detector and the second implantable detector can be coupled to the at least two electrodes with opposite polarity.

In many embodiments, the target tissue comprises a cochlea of the user, and the first pulse width modulated light signal and the second pulse width modulated light signal comprise an audio signal.

In another aspect embodiments of the present invention provide a device to transmit a sound to a user. The device comprises means for transmitting light energy, and means for hearing the sound in response to the transmitted light energy

DETAILED DESCRIPTION OF THE INVENTION

Figure 1:
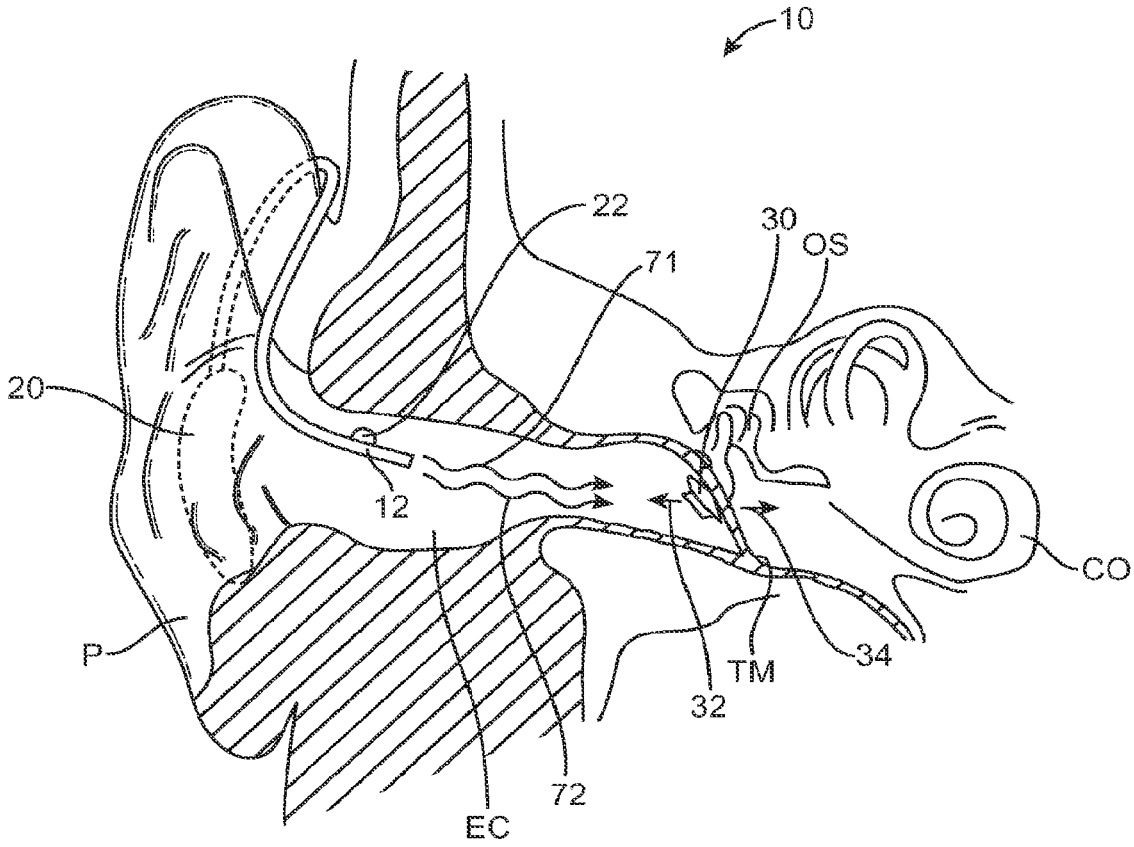
FIG. 1 shows a hearing system using optical-electrical coupling to generate a mechanical signal, according to embodiments of the present invention.

Embodiments of the present invention can be used in many applications where tissue is stimulated with at least one of vibration or an electrical current, for example with wireless communication, the treatment of neurological disorders such as Parkinson's, and cochlear implants. An optical signal can be transmitted to a photodetector coupled to tissue so as to stimulate tissue. The tissue can be stimulated with at least one of a vibration or an electrical current. For example, tissue can be vibrated such that the user perceives sound. Alternatively or in combination, the tissue such as neural tissue can be stimulated with an electrical current such that the user perceives sound. The optical signal transmission architecture described herein can have many uses outside the field of hearing and hearing loss and can be used to treat, for example, neurological disorders such as Parkinson's.

Embodiments of the present invention can provide optically coupled hearing devices with improved audio signal transmission. The systems, devices, and methods described herein may find application for hearing devices, for example open ear canal hearing aides, middle ear implant hearing aides, and cochlear implant hearing aides. Although specific reference is made to hearing aid systems, embodiments of the present invention can be used in any application where sound is amplified for a user, for example with wireless communication and for surgically implanted hearing devices such as middle implants and cochlear implants.

As used herein, a width of a light pulse encompasses a duration of the light pulse.

In accordance with many embodiments, the photon property of light is used to selectively transmit light signals to the users, such that many embodiments comprise a photonic hearing aide. The semiconductor materials and photostrictive materials described herein can respond to light wavelengths with band gap properties such that the photon properties of light can be used beneficially to improve the sound perceived by the user. For example, first light photons having first photon energies above a first bandgap of a first absorbing material can result in a first movement of the transducer assembly, and second light photons having second photon energies above a second bandgap of a second absorbing material can result in a second movement of the transducer assembly opposite the first movement.

The transducer assembly may comprise one or more of many types of transducers that convert the light energy into a energy that the user can perceive as sound. For example, the transducer may comprise a photostrictive transducer that converts the light energy to mechanical energy. Alternatively or in combination, the transducer assembly may comprise a photodetector to convert light energy into electrical energy, and another transducer to convert the electrical energy into a form of energy perceived by the user. The transducer to convert the electrical energy into the form of energy perceived by the user may comprise one or more of many kinds of transducers such as the transducer comprises at least one of a piezoelectric transducer, a flex tensional transducer, a balanced armature transducer or a magnet and wire coil. Alternatively or in combination, at least one photodetector can be coupled to at least two electrodes to stimulate tissue of the user, for example tissue of the cochlea such that the user perceives sound.

A hearing aid system using opto-electro-mechancial transduction is shown in FIG. 1. The hearing system 10 includes an input transducer assembly 20 and an output transducer assembly 30. As shown in FIG. 1, the input transducer assembly 20 is located at least partially behind the pinna P, although an input transducer assembly may be located at many sites such as in pinna P or entirely within ear canal EC. The input transducer assembly 20 receives a sound input, for example an audio sound. With hearing aids for hearing impaired individuals, the input is ambient sound. The input transducer assembly comprises an input transducer, for example a microphone 22. Microphone 22 can be positioned in many locations such as behind the ear, if appropriate. Microphone 22 is shown positioned within ear canal near the opening to detect spatial localization cues from the ambient sound. The input transducer assembly can include a suitable amplifier or other electronic interface. In some embodiments, the input may be an electronic sound signal from a sound producing or receiving device, such as a telephone, a cellular telephone, a Bluetooth connection, a radio, a digital audio unit, and the like.

Input transducer assembly 20 includes a light source such as an LED or a laser diode. The light source produces a modulated light output based on the sound input. The light output is delivered to a target location near or adjacent to output transducer assembly 30 by a light transmission element 12 which traverses ear canal EC. Light transmission element 12 may be an optic fiber or bundle of optic fibers. The light sources of the input transducer assembly can be positioned behind the ear with a behind the ear unit, also referred to as a BTE unit, and optically coupled to the light transmission element that extends from the BTE unit to the ear canal when the device is worn by the patient. In some embodiments, the light source(s), such as at least one LED or at least one laser diode can be placed in the ear canal to illuminate the output transducer assembly 30 and send the signal and power optically to the output transducer assembly.

As shown in FIG. 1, the light output includes a first light output signal $\lambda_1$ and second light output signal $\lambda_2$. The nature of the light output can be selected to couple to the output transducer assembly 30 to provide both the power and the signal so that the output transducer assembly 30 can produce mechanical vibrations. When properly coupled to the subject's hearing transduction pathway, the mechanical vibrations induce neural impulses in the subject which are interpreted by the subject as the original sound input.

The output transducer assembly 30 can be configured to couple to some point in the hearing transduction pathway of the subject in order to induce neural impulses which are interpreted as sound by the subject. As shown in FIG. 1, the output transducer assembly 30 is coupled to the tympanic membrane TM, also known as the eardrum. First light output signal $\lambda_1$ comprises light energy to exert a first force at output transducer assembly 30 to move the eardrum in a first direction 32 and second light output signal $\lambda_2$ comprises light energy to exert second force with output transducer assembly 30 to move the eardrum in a second direction 34, which can be opposite to first direction 32. Alternatively, the output transducer assembly 15 may couple to a bone in the ossicular chain OS or directly to the cochlea CO, where it is positioned to vibrate fluid within the cochlea CO. Specific points of attachment are described in prior U.S. Pat. Nos. 5,259,032; 5,456,654; 6,084,975; and 6,629,922, the full disclosures of which are incorporated herein by reference and may be suitable for combination in accordance with some embodiments of the present invention.

The output transducer assembly 30 can be configured in many ways to exert the first force at output transducer assembly 30 in a first direction 32 in response to first light output signal $\lambda_1$ and to exert the second force in second direction 34 in response to a second light output signal $\lambda_2$. For example, the output transducer assembly may comprise photovoltaic materials that transduce optical energy to electrical energy and which are coupled to a transducer to drive the transducer with electrical energy. Output transducer assembly 30 may comprise a magnetostrictive material. The output transducer assembly 30 may comprise a first photostrictive material configured to move in a first direction in response to a first wavelength and to move in a second direction in response to a second wavelength. Photostrictive materials are described in U.S. Pub. No. 2006/0189841, entitled "Systems and methods for photo-mechanical hearing transduction". The output transducer assembly may comprise a cantilever beam configured to bend in a first direction in response to a first at least one wavelength of light and bend in a second direction opposite the first direction in response to a at least one second wavelength of light. For example, the first at least one wavelength of light may comprise energy above a bandgap of a semiconductor material to bend the cantilever in the first direction, and the second at least one wavelength may comprise energy below the bandgap of the semiconductor to bend the cantilever in the second direction. An example of suitable materials and cantilevers are described in U.S. Pat. No. 6,312,959.

The output transducer assembly 280 may be replaced at least two electrodes, such that assembly 30 comprises an output electrode assembly. The output electrode assembly can be configured for placement at least partially in the cochlea of an ear of the user.

In some embodiments, the transducer assembly can be located in the middle ear, and the light energy can be transmitted from the emitters through epithelial cells of the skin of the eardrum from the transmitter to the one or more photodetectors of the transducer assembly located in the middle ear. Further, the transducer assembly may be located at least partially within the inner ear of the user and the light energy transmitted from the emitters through the eardrum to the one or more detectors.

Figure 2:
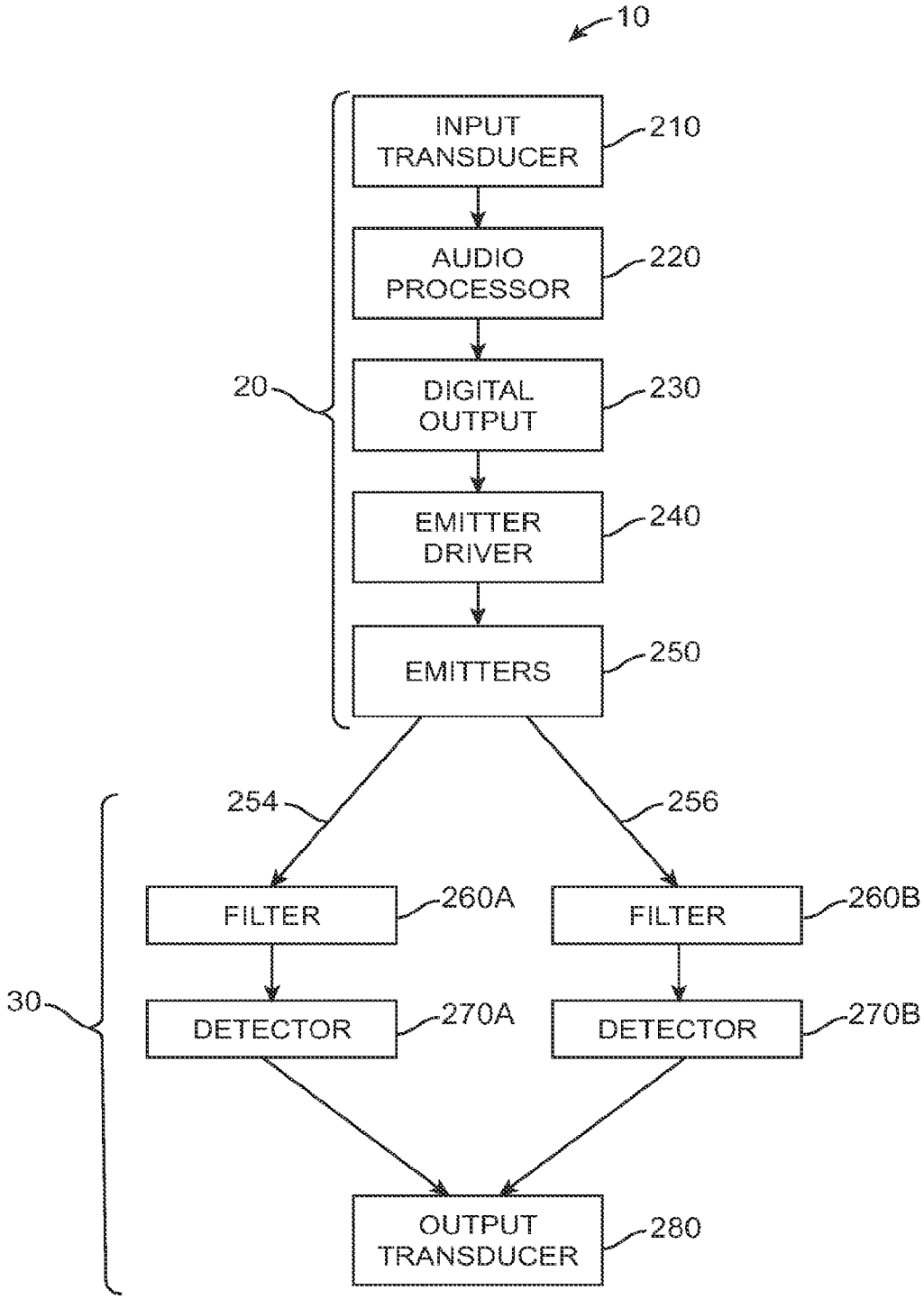
FIG. 2 is a schematic representation of the components of the hearing system as in FIG. 1.

FIG. 2 schematically depicts additional aspects of hearing system 10. The input transducer assembly 20 may comprise an input transducer 210, an audio processor 220, an emitter driver 240 and emitters 250. The output transducer assembly 30 may comprise filters 260*a*, 260*b*, detectors 270*a*, 270*b*, and an output transducer 280. Input transducer 210 takes ambient sound and converts it into an analog electrical signal. Input transducer 210 often includes a microphone which may be placed in the ear canal, behind the ear, in the pinna, or generally in proximity with the ear. Audio processor 220 may provide a frequency dependent gain to the analog electrical signal. The analog electrical signal is converted to a digital electrical signal by digital output 230. Audio processor 220 may comprise many known audio processors, for example an audio processor commercially available from Gennum Corporation of Burlington, Canada and a GA3280 hybrid audio processor commercially available from Sound Design Technologies, Ltd. of Burlington Ontario, Canada. The single analog signal can be processed and converted into a dual component electrical signal. Digital output 230 includes a modulator, for example, a pulse-width modulator such as a dual differential delta-sigma converter. The output may also comprise a frequency modulated signal, for example frequency modulated of fixed pulse width modulated in response to the audio signal. Emitter driver 240 processes the digital electrical signal so that it is specific to optical transmission and the power requirements of emitters 250. Emitters 250 produce a light output representative of the electrical signal. For a dual component electrical signal, emitters 250 can include two light sources, one for each component, and produce two light output signals 254, 256. Light output signal 254 may be representative of a positive sound amplitude while light output signal 256 may representative of a negative sound amplitude. Each light source emits an individual light output, which may each be of different wavelengths. The light source may be, for example, an LED or a laser diode, and the light output may be in the infrared, visible, or ultraviolet wavelength. For example, the light source may comprise an LED that emits at least one wavelength of light comprising a central wavelength and a plurality of wavelength distributed about the central wavelength with a bandwidth of about 10 nm. The light source may comprise a laser diode that emits at least one wavelength of light comprising a central wavelength with a bandwidth no more than about 2 nm, for example no more than about 1 nm. The first at least one wavelength from the first source can be different from the second at least one wavelength from the second source, for example different by at least 20 nm, such that the first at least one wavelength can be separated from the second at least one wavelength of light. The first at least one wavelength may comprise a first bandwidth, for example 60 nm, and the second at least one wavelength may comprise a second bandwidth, for example 60 nm, and the first at least one wavelength can be different from the second at least one wavelength by at least the bandwidth and the second bandwidth, for example 120 nm.

The light output signals travel along a single or multiple optical paths though the ear canal, for example, via an optic fiber or fibers. The light output signals may spatially overlap. The signals are received by an output transducer assembly that can be placed on the ear canal. First detector 270*a* and second detector, 270*b* receive the first light output signal 254 and the second light output signal 256. Detectors 270*a*, 270*b* include at least one photodetector provided for each light output signal. A photodetector may be, for example, a photovoltaic detector, a photodiode operating as a photovoltaic, or the like. The first photodetector 270*a* and the second photodetector 270*b* may comprise at least one photovoltaic material such as crystalline silicon, amorphous silicon, micromorphous silicon, black silicon, cadmium telluride, copper indium gallium selenide, and the like. In some embodiments, at least one of photodetector 270*a* or photodetector 270*b* may comprise black silicon, for example as described in U.S. Pat. Nos. 7,354,792 and 7,390,689 and available from SiOnyx, Inc. of Beverly, Mass. The black silicon may comprise shallow junction photonics manufactured with semiconductor process that exploits atomic level alterations that occur in materials irradiated by high intensity lasers, such as a femtosecond laser that exposes the target semiconductor to high intensity pulses as short as one billionth of a millionth of a second. Crystalline materials subject to these intense localized energy events may under go a transformative change, such that the atomic structure becomes instantaneously disordered and new compounds are "locked in" as the substrate re-crystallizes. When applied to silicon, the result can be a highly doped, optically opaque, shallow junction interface that is many times more sensitive to light than conventional semiconductor materials.

Filters 260*a*, 260*b* can be provided along the optical path. Filters 260*a*, 260*b* can separate the light output signals. For example, a first filter 260*a* may be provided to transmit the first wavelength of first output 254 and a second filter 260*b* can transmit the second wavelength of second output 256. Filters may be any one of the thin film, interference, dichroic, or gel types with either band-pass, low-pass, or high-pass characteristics. For example, the band-pass characteristics may be configured to pass the at least one wavelength of the source, for example configured with at least a 60 nm bandwidth to pass a 200-300 nm bandwidth source, as described above. The low-pass and high-pass maybe combined to pass only one preferred wavelength using the low-pass filter and the other wavelength using the high-pass filter.

For a dual component signal, the output transducer 280 recombines two electrical signals back into a single electrical signal representative of sound. The electrical signal representative of sound is converted by output transducer 280 into a mechanical energy which is transmitted to a patient's hearing transduction pathway, causing the sensation of hearing. The transducer may be a piezoelectric transducer, a flex tensional transducer, a magnet and wire coil, or a microspeaker.

Although reference is made in FIG. 2 to a hearing device comprising two light sources and two detectors, alternative embodiments of the present invention may comprise a hearing device with a single light source and a single detector, for example a device comprising a single pulse width modulated light source coupled to a single detector.

Figure 2A:
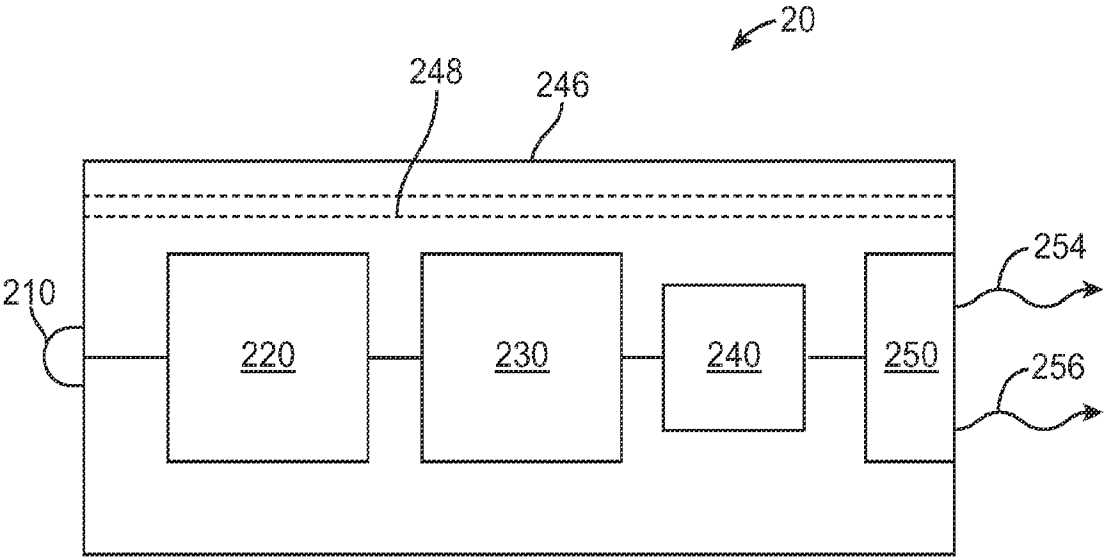
FIG. 2A shows components of an input transducer assembly positioned in a module sized to fit in the ear canal of the user.

FIG. 2A shows components of input transducer assembly 20 positioned in a module sized to fit in the ear canal of the user. The module may comprise an outer housing 246 shaped to the ear of the user, for example with a mold of the ear canal. The module may comprise a channel extending from a proximal end where the input transducer 210 is located to a distal end from which light is emitted, such that occlusion is decreased.

Figure 3A:
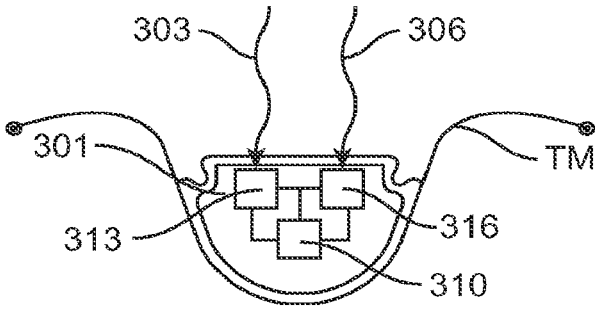
FIGS. 3A and 3B show an electro-mechanical transducer assembly for use with the system as in FIGS. 1 and 2.
Figure 3B:
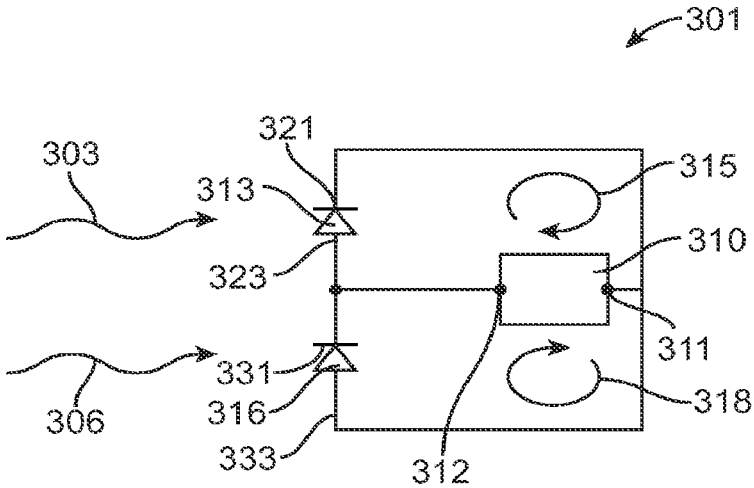

FIG. 3A shows an output transducer 301 placed on the tympanic membrane TM, also referred to as the eardrum. FIG. 3B shows a simple representation of the circuitry of output transducer 301 which can be used to convert light output signals into mechanical energy. Transducer 301 includes photodetectors 313, 316. Photodetectors 313, 316 capture light output signals 303, 306, respectively, and convert the light output into electrical signals. Photodetectors 313 and 316 are shown with an inverse polarity relationship. As seen in FIG. 4B, both cathode 321 of photodetector 313 and anode 333 of photodetector 316 are connected to terminal 311 of load 310. Both cathode 331 of photodetector 313 and anode 323 of photodetector 316 are connected to terminal 312 of load 310. Thus, light output signal 303 drives a current 315, or a first voltage, in one direction while light output signal 306 drives a current 318, or a second voltage, in the opposite direction. Currents 315, 318 cause load 310 to move and cause a mechanical vibration representative of a sound input. Load 310 may be moved in one direction by light output 303. Light output 306 moves load 310 in an opposite direction. Load 310 may comprise a load from at least one of a piezoelectric transducer, a flex tensional transducer, or a wire coil coupled to an external magnet.

Figure 3C:
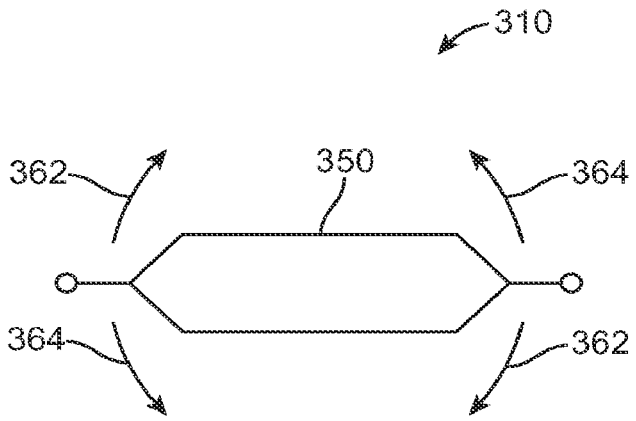
FIG. 3C shows a first rotational movement comprising first rotation with a flex tensional transducer and a second rotation movement comprising a second rotation opposite the first rotation, according to embodiments of the present invention.

FIG. 3C shows a first rotational movement comprising first rotation 362 with a flex tensional transducer 350 and a second rotation movement comprising a second rotation 364 opposite the first rotation.

Figure 3D:
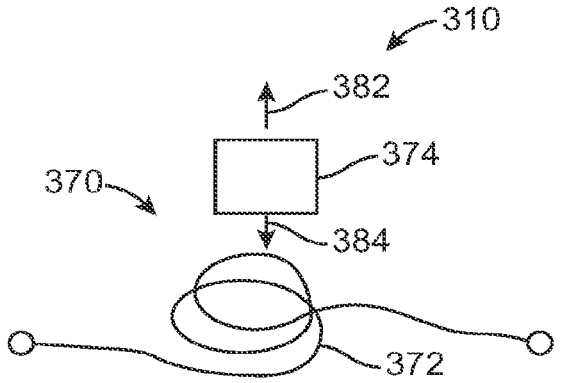
FIG. 3D shows a translational movement in a first direction with a coil and magnet and a second translational movement in a second direction opposite the first direction; according to embodiments of the present invention.

FIG. 3D shows a first translational movement in a first direction 382 and a second translational movement in a second direction 384 opposite the first direction with transducer 370 comprising a coil 372 and magnet 374.

Figure 3E:
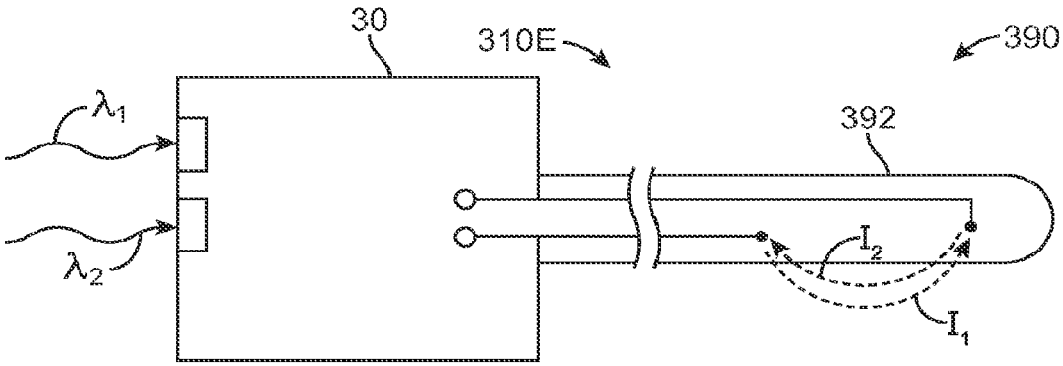
FIG. 3E shows an implantable output assembly for use with components of a system as in FIGS. 1 and 2, and may comprise components of assemblies as shown in FIGS. 3A to 3D.

FIG. 3E shows an implantable output assembly for use with components of a system as in FIGS. 1 and 2, and may comprise components of assemblies as shown in FIGS. 3A to 3D. The implantable output assembly 30 may comprise at least two electrodes 390 and an extension 392 configured to extend to a target tissue, for example the cochlea. The at least two electrodes can be coupled to the circuitry so as to comprise a load 310E in a manner similar to transducer 310 described above. The implantable output assembly can be configured for placement in many locations and to stimulate many target tissues, such as neural tissue. A current flows between the at least two electrodes in response to the optical signal. The current may comprise a first current I1 in a first direction in response to a first at least one wavelength $\lambda_1$ and a second current 12 in response to a second at least one wavelength $\lambda_2$. The implantable output assembly can be configured to extend from the middle ear to the cochlea. The implantable output assembly can be configured in many ways to stimulate a target tissue, for example to stimulate a target neural tissue treat Parkinson's.

Figure 4:
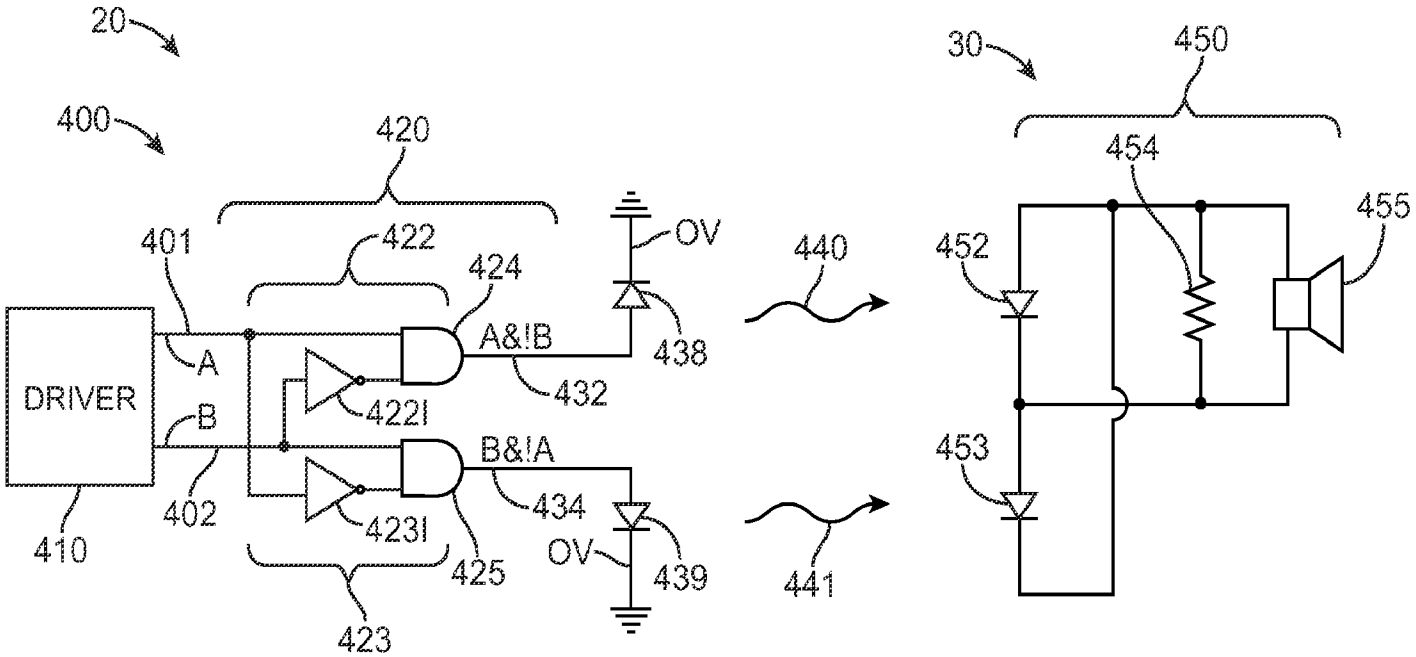
FIG. 4 shows circuitry of a hearing system, as in FIGS. 1 and 2.

FIG. 4 shows circuitry for use with hearing system 10. The input circuitry 400 may comprise a portion of input transducer assembly 20 of hearing system 10 and output circuitry 450 may comprise a portion output transducer assembly 30. Input transducer circuitry 400 comprises a driver 410, logic circuitry 420 and light emitters 438 and 439. Output circuitry 450 comprises photodetectors 452, 455 and transducer 455. Input transducer circuitry 400 is optically coupled to output circuitry 450 with light emitters 438 and 439 and photodetectors 452, 455. The components of input circuitry 400 can be configured to create differential-sigma signal, which can be transmitted to output circuitry 450 to provide single output signal of positive and negative amplitude at transducer 455, for example signal 460 of FIG. 5 described below. The signal at transducer 455 vibrates transducer 455 to provide high fidelity sound for the user.

Driver 410 provides first digital electrical signal 401 and a second digital electrical signal 402, which can be converted from a single analog sound output by a modulator, for example driver 410. First signal 401 may comprise a first signal A and second signal 402 may comprise a second signal B. The modulator may comprise a known dual differential delta-sigma modulator.

Logic circuitry 420 can include first logic components 422 and second logic components 423. First logic components 422 comprise a first inverter 4221 and a first AND gate 424. Second logic components 423 comprise a second inverter 4231 and a second AND gate 424. The input to first logic components 422 comprises signal A and signal B and the input to second logic components 423 comprises signal A and signal B. Output 432 from first logic components 422 comprises the condition (A and Not B) of signal A and signal B (hereinafter "A&!B"). Output 434 from second logic components 423 comprises the condition (B and Not A) of signal A and signal B (hereinafter "B&!A"). Light emitters 438, 439 transmit light output signals through light paths 440, 441 to output transducer assembly 450. Light paths 440, 441 may be physically separated, for example through separate fiber optic channels, by the use of polarizing filters, or by the use of different wavelengths and filters.

The output 432 of the AND gate 424 drives light emitter 438, and the output 434 of AND gate 425 drives light emitter 429. Emitter 438 is coupled to detector 452 by light path 440, and emitter 439 is coupled to detector 453 through light path 441. These paths may be physically separated (through separate fiber optic channels, for example), or may be separated by use of polarizing filters or by use of different wavelengths and filters.

Output transducer assembly 450 includes photodetectors 452, 455 which receive the light output signals and convert them back into electrical signals. Output circuitry 450 comprises transducer 455 which recombines and converts the electrical signals into a mechanical output. As shown, the photodetectors 452, 453 are connected in an opposing parallel configuration. Detectors 452 and 453 may comprise photovoltaic cells, connected in opposing parallel in order to produce a bidirectional signal, since conduction may not occur below the forward diode threshold voltage of the photovoltaic cells. Their combined outputs are connected to drive transducer 455. Through the integrating characteristic of the photovoltaic cells a voltage of positive and negative polarity corresponding to the intended analog voltage is provided to the transducer. Filters maybe used on the detectors to further reject light from the opposite transmitter, as described above. The filters may be of the thin film or any other type with band-pass, low-pass, or high-pass characteristics, as described above.

If the transducer of output circuitry 450 is substantially incapable of conducting direct current, a shunt resistor 454 may be used to drain off charge and to prevent charge buildup which may otherwise block operation of the circuit.

The output circuitry 450 may also be configured so that more than two photodetectors are provided. For example the more than two photodetectors may be connected in series, for example for increased voltage. The more than two photodetectors may also be connected in parallel, for example for increased current.

Figure 5:
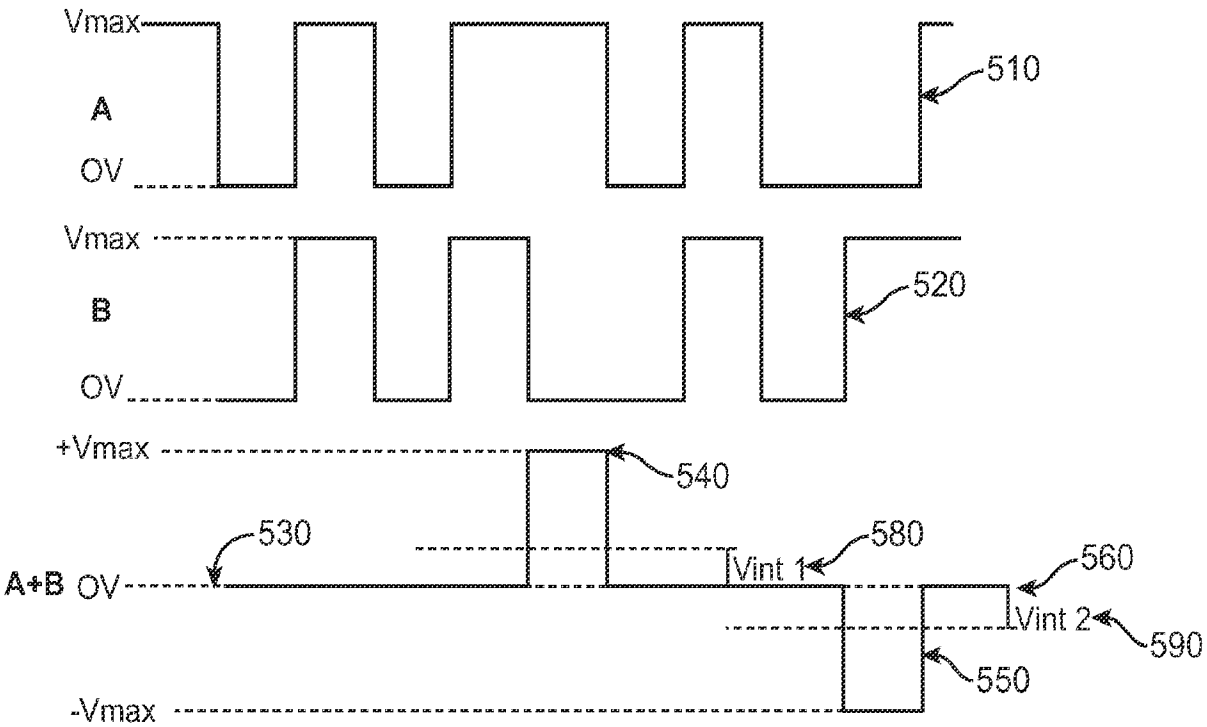
FIGS. 5 and 5A show a pair of complementary digital signals for use with circuitry as in FIG. 4.
Figure 5A:
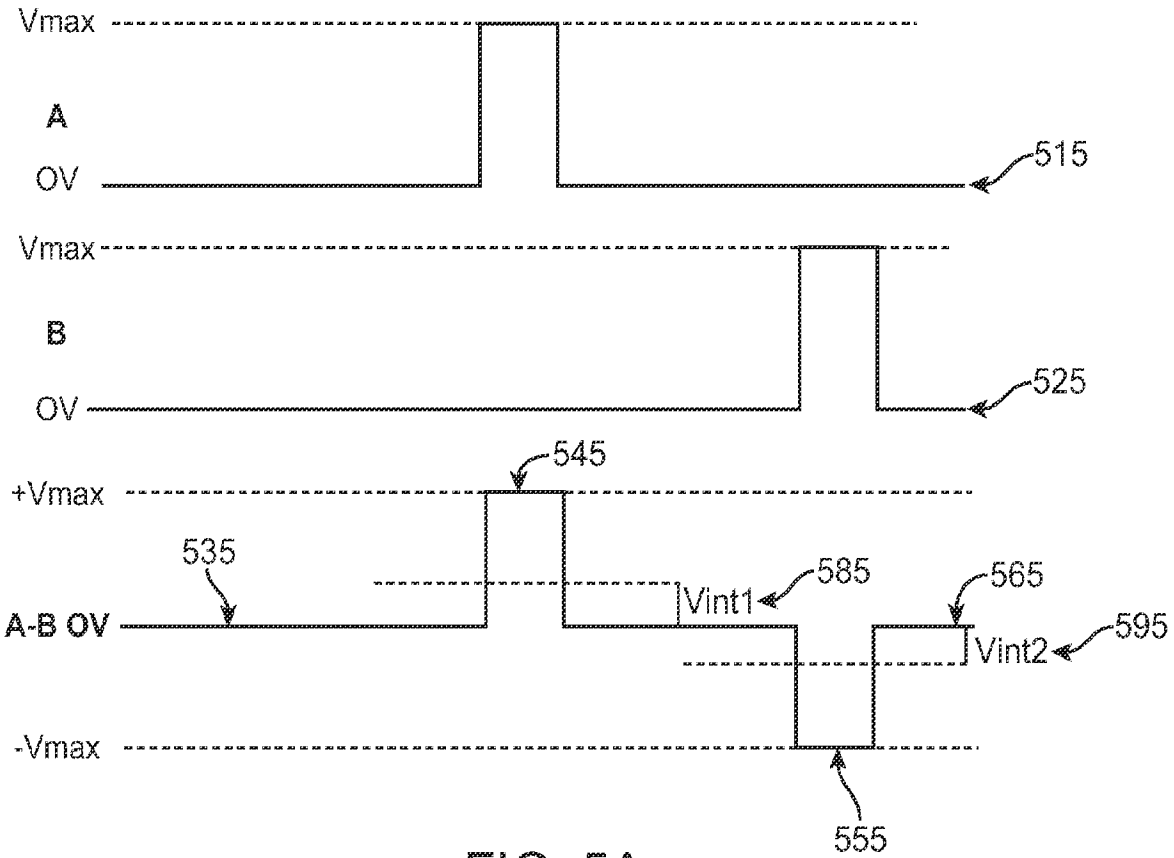

FIGS. 5 and 5A show dual pulse width modulation schemes that may be used to modulate the audio signals with the circuitry of FIG. 4. In FIG. 5, two digital electrical signals comprising first signal component 510 and second signal component 520 are complementary and in combination encode a signal representative of sound. First signal component 510 may comprise first digital electrical signal 401, which comprises signal A, shown above. Second signal component 520 may comprise second digital electrical signal 402, which comprises signal B, shown above.

While an analog sound signal may vary positively and negatively from a zero value, digital signals such as signal components 510 and 520 can vary between a positive value and a zero value, i.e. it is either on or off. The hearing system converts the analog electrical signal representative of sound into two digital electrical signal components 510 and 520. For example, first signal component 510 can have a duty cycle representative of the positive amplitudes of a sound signal while second signal component 520 has a duty cycle representative of the inverse of the negative amplitudes of a sound signal. Each signal component 510 and 520 is pulse width modulated and each ranges from 0V to $V_{max}$. An output transducer assembly, as described above, recombines the signal components 510 and 520 into an analog electrical signal representative of sound.

As shown in FIG. 5, the signal components 510 and 520 can be combined by subtracting first signal component 510 from second signal component 520 to create a single output signal 560. Single output signal 560 can correspond to the signal to the transducer. Second signal component 520 can be subtracted from first signal component 510 with analog subtraction of the signals with the photodetectors. For example, a single voltage can be applied across the transducer from the first detector and the second detector with the reversed polarity as described above. As shown in FIG. 5, signal components 510 and 520 overlap temporally. Signal component 510 and signal component 520 can drive the light emitters, such that the first wavelength of light comprises at least one wavelength of light from the second emitter source. Single output signal 560 can have three states: a zero state 530, a positive state 540, and a negative state 550. The zero state 530 occurs when both signal component 510 and signal component 520 are equal to each other, for example, when both signal components 510 and 520 are at 0V or both are at Vmax. The positive and negative pulses of the single output signal 560 can be generated with subtraction of second signal component 520 from first signal component 510. The positive and negative pulses of the single output signal 560 can be integrated, for example into positive amplitudes value 580 and negative amplitude value 590, respectively, to determine the amplitude and/or voltage of the analog signal. For example, the amplitude values 580 and 590 are equal to the duty cycle multiplied by the pulse amplitude of the positive state 540 and negative state 550, respectively. Signal 560 can thereby be representative of sound which has both negative and positive values.

FIG. 5A shows a dual pulse-width modulation scheme using a first signal component 515 and second signal component 525 configured to minimize power use. Signal components 515 and 525 can be generated from signal 510 comprising signal A and signal 520 comprising signal B with logic circuitry, so as to decrease output of the LED's and extend the battery lifetime. For example, signal components 515 and 525 can be generated from signal 401, which comprises signal A, and signal 402, which comprises signal B, with logic circuitry 420, described above. For example, first signal component 515 comprises first output from logic circuitry 420, and second signal component 525 comprises a second output from logic circuitry 420. Logic circuitry 420 can produce an output 432 comprising the condition A and Not B of signal A and signal B. First signal component 515 comprises the A and Not B condition of signal A and signal B, for example of the A and Not B condition signal 510 signal 520. Second signal component 525 comprises the B and Not A condition of signal B and signal A, for example the B and Not A condition of signal 520 and signal 510. The pulses of signal components 515 and 525 do not overlap temporally.

Signal component 525 is subtracted from signal component 515 with analog subtraction to form a single output signal 565. Single output signal 565 can have three states: a zero state 535, a positive state 545, and a negative state 555. The positive and negative pulses of the single output signal 565 can be integrated, for example into positive amplitudes value 585 and negative amplitude value 595, respectively, to determine the amplitude and/or voltage of the analog signal. For example, the amplitude values 585 and 595 are equal to the duty cycle multiplied by the pulse amplitude of the positive state 545 and negative state 555, respectively. Signal 565 can thereby be representative of sound which has both negative and positive values. The zero state 525 occurs when both signal components 515 and 525 are at 0V. Therefore, the quiescent, or zero state, does consume output power from the light sources.

Referring now to FIGS. 4, 5, and 5A, driver 410 provides first digital electric signal 401 comprising signal A and second digital electric signal 402 comprising signal B. Signal A may comprise first signal 501 and second signal 502 in the differential delta-sigma converter diagram shown in FIG. 5. Signal condition 515 corresponds to the output of light emitter 438 and is determined by the condition (A and Not B) of signal A and signal B, also referred to as A&!B. Signal condition 525 corresponds to the output of emitter 439 and is determined by condition (B and Not A) of signal A and signal B, also referred to as B&!A. First light source 438 can be driven with the A&!B signal and second light source 439 can be driven with the B&!A signal, such that first light pulses from first light source 438 do not overlap temporally with second light pulses from second light source 439. For example output 432 may correspond to positive state 545 of the difference signal A-B, and output 434 may correspond to the negative state 555 of the difference signal A-B, such that the first pulses do not overlap with the second pulses. Therefore, the output of light emitter 438 and light emitter 439 can be significantly reduced and provide a high fidelity signal to the user with optically coupled movement of transducer 455.

Figure 6:
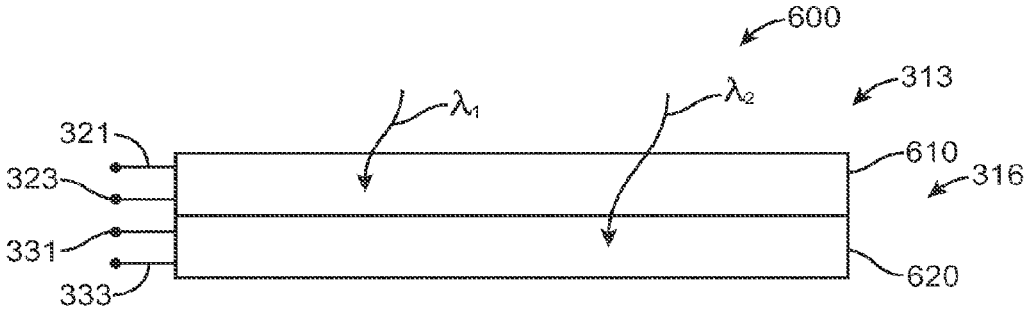
FIG. 6 shows a stacked arrangement of photo detectors, according to embodiments of the present invention.

FIG. 6 shows a stacked arrangement of photodetectors 600. This arrangement of detectors can be positioned on the output transducer assembly positioned on the eardrum, and can provide greater surface area for each light output signal detected. For example, the combined surface area of the detectors may be greater than a cross-sectional area of the ear canal. A first photodetector 610 is positioned over a second photodetector 620. First photo detector 610 receives the first light output signal $\lambda_1$ and second photo detector 620 receives the second light output signal $\lambda_2$. The first photo detector absorbs the first light output signal comprising the first at least one wavelength of light. The second photodetector receives the second light output signal comprising the second at least one wavelength of light. The first photo detector absorbs the first light output and transmits the second light output signal to the second photodetector, which second detector absorbs the second light output. The first light output signal is converted to a first electrical signal with the first photo detector and the second light output signal is converted to a second electrical signal with the second detector. The first photo detector and the second photo detector can be configured in an inverse polarity relationship as described above. For example, both cathode 321 and anode 333 can be connected to terminal 311 of load 310, and both cathode 331 and anode 323 can be connected to terminal 312 of load 310 as described above. Thus, the first light output signal and the second light output signal can drive the transducer in a first direction and a second direction, respectively, such that the cross sectional size of both detectors positioned on the assembly corresponds to a size of one of the detectors. The first detector may be sensitive to light comprising at least one wavelength of about 1 um, and the second detector can be sensitive to light comprising at least one wavelength of about 1.5 um. The first detector may comprise a silicon (hereinafter "Si") detector configured to absorb substantially light having wavelengths from about 700 to about 1100 nm, and configured to transmit substantially light having wavelengths from about 1400 to about 1700 nm, for example from about 1500 to about 1600 nm. For example, the first detector can be configured to absorb substantially light at 904 nm. The second detector may comprise an Indium Galium Arsenide detector (hereinafter "InGaAs") configured to absorb light transmitted through the first detector and having wavelengths from about 1400 to about 1700 nm, for example from about 1500 to 1600 nm, for example 1550 nm. In a specific example, the second detector can be configured to absorb light at about 1310 nm. The cross sectional area of the detectors can be about 4 mm squared, for example a 2 mm by 2 mm square for each detector, such that the total detection area of 8 mm squared exceeds the cross sectional area of 4 mm squared of the detectors in the ear canal. The detectors may comprise circular detection areas, for example a 2 mm diameter circular detector area. As the ear canal can be non-circular in cross-section, the detector surface area can be non-circular and rounded, for example elliptical with a size of 2 mm and 3 mm along the minor and major axes, respectively. The above detectors can be fabricated by many vendors, for example Hamamatsu of Japan (available on the world wide web at "hamamatsu.com") and NEP corporation.

The rise and fall times of the photo detectors can be measured and used to determine the delays for the circuitry. The circuitry can be configured with a delay to inhibit noise due to a silicon detector that is slower than an InGaAs detector. For example, the rise and fall times can be approximately 100 ns for the InGaAs detector, and between about 200 ns and about 10 us for the silicon detector. Therefore, the circuitry can be configured with a built in compensation delay within a range from about 100 ns (200 ns−100 ns) to about 10 us (10 us−10 ns) so as to inhibit noise due to the silicon detector that is slower than the InGaAs detector. The compensation adjustments can include a pulse delay as well as pulse width adjustment, so as to account for the leading and trailing edge delays. A person of ordinary skill in the art can make appropriate measurements of the detectors to determine appropriate delays of the compensation circuitry so as to inhibit noise due to the first delay different from the second delay, based on the teachings described herein.

The capacitance of the first detector can differ from the capacitance of the second detector, such that the first detector can drive the transducer assembly with a first time delay and the second detector can drive the transducer with a second delay, in which the first delay differs from the second delay. The first detector may have a first sensitivity to light at the first at least one wavelength, and the second detector may have a second sensitivity to light at the second at least one wavelength, in which the first sensitivity differs from the second sensitivity. Work in relation to some embodiments suggests that these differences in timing and sensitivity may result in perceptible noise to the user, and that it can be helpful to inhibit this noise.

Figure 7:
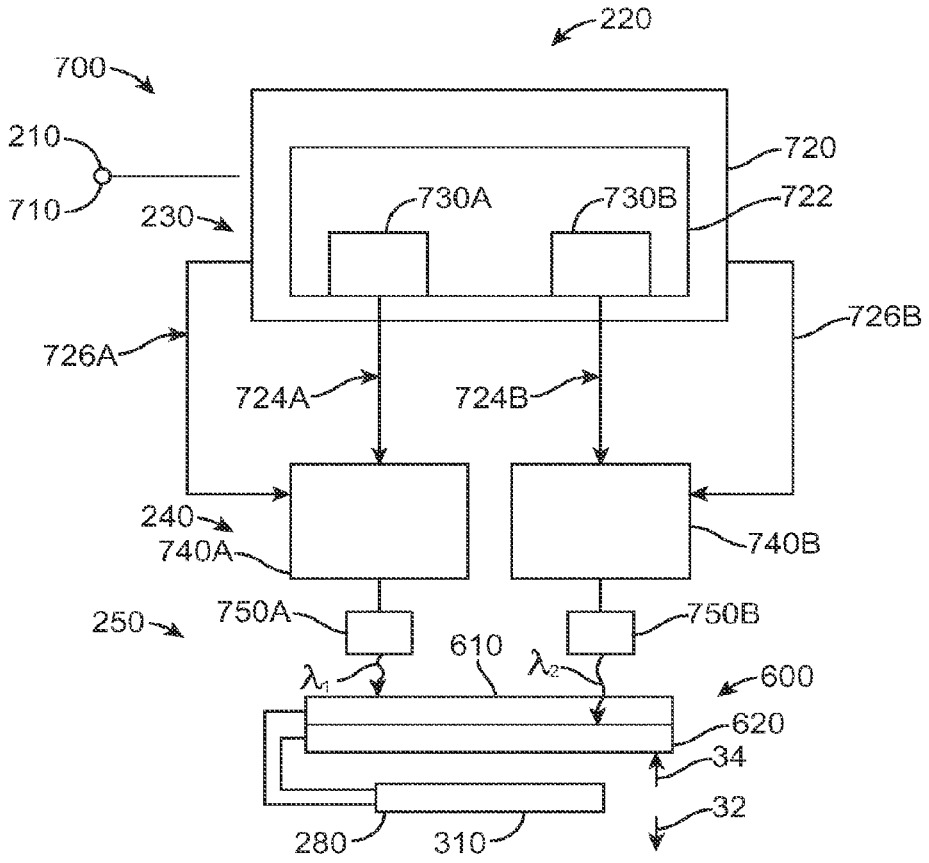
FIG. 7 shows circuitry configured to adjust the intensity and timing of the signals as in FIGS. 5 and 5A.

FIGS. 7 shows circuitry 700 configured to adjust the intensity and timing of the signals as in FIGS. 5 and 5A, and may comprise many components similar to the input transducer assembly described above. Circuitry 700 may comprise components of the input transducer assembly and may comprise the circuitry of the input transducer assembly. Circuitry 700 comprises an input transducer 710. Input transducer 710 is coupled to an audio processor 720. Audio processor 720 comprises a tangible medium 722 Tangible medium 722 comprises computer readable instructions of a computer program such that processor 720 is configured to implement the instructions embodied in the tangible medium. Audio processor 720 can be configured to process the speech and to determine the pulse with modulation signal, for example delta sigma modulation as noted above. Digital output 730 can comprises a first digital output 730A and a second digital output 730B stored in at least one buffer of the tangible medium 722. The first digital output 730A can be coupled to a first emitter driver 740A with a first line 724A, and the second digital output 730B can be coupled to a second emitter driver 740B with a second line 724B. First emitter driver 740A is coupled to first emitter 250A and second emitter driver 740B is coupled to second emitter 250B.

The second photo detector receives the second light output signal $\lambda_1$ and drives the output transducer assembly in second direction 32 a second amount. As the efficiency of light output from the emitters can be different, and the sensitivity of the detectors can be different, the first amount can differ from the second amount.

The intensity of the emitters can be adjusted in many ways so as to correct for differences in gain of the emitted signal and corresponding movement of the transducer assembly in the first direction relative to the first direction. For example, the intensity of each emitter can be adjusted manually, or the adjustment can be implemented with the processor, or a combination thereof. The intensity of one emitter can be adjusted relative to the other emitter, such that the noise perceived is inhibited, even minimized. The relative adjustment may comprise adjusting the intensity of one of the emitters when the intensity of the other emitter remains fixed. For example, a first control line 726A can extend from the processor to the first emitter driver such that the processor and/or user can adjust the intensity of light emitted from the first emitter driver. A second control line 726B can extend from the processor to the second emitter driver such that the processor and/or user can adjust the intensity of light emitted from the first emitter driver. The first emitter 750A emits the first light output signal $\lambda_1$ and the second emitter 750B emits the second light output signal $\lambda_2$ in response to the intensity set by the control lines. The first photo detector receives the first light output signal $\lambda_1$ and drives the output transducer assembly in first direction 32 a first amount.

The circuitry 700 may comprise additional components to inhibit the noise, to increase the output of the transducer assembly, or a combination thereof. For example, a buffer 790 external to the audio processor can be configured to store the output to the first emitter so as to delay the output to the first emitter. For example, with a 200 kHz digital output PWM signal corresponding to 5 us timing resolution, a first in first out (FIFO) buffer configured to store serial digital output corresponding to 100 outputs generates a delay of 500 us in the signal transmitted to the first emitter. The first signal to the first emitter can be delayed with circuitry coupled to the first emitter. For example at least one of a resistor, a capacitor or an inductor can be coupled to the circuitry that drives the emitter. For example, a passive resistor and capacitor network can be disposed between first emitter driver 740A and first emitter 750A to delay the first signal relative to the second signal.

The circuitry 700 may be configured to drive at least two electrodes, for example to stimulate a cochlea of the user such that the user perceives sound. For example, the output transducer 280 may be replaced with at least two electrodes, as described above.

Figure 7A:
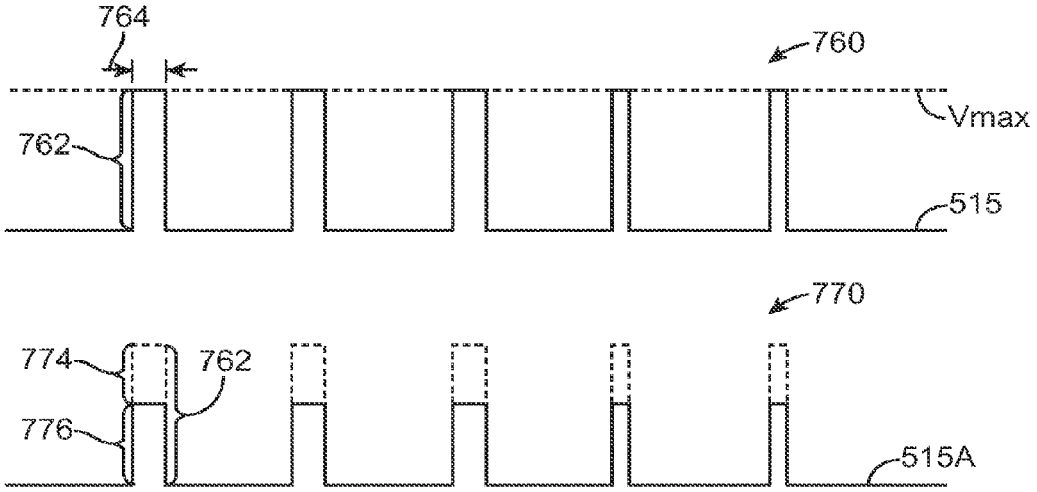
FIG. 7A shows adjusted amplitude of the signals with circuitry as in FIG. 7.

FIG. 7A shows adjusted amplitude of the signals with circuitry as in FIG. 7. A first signal component 515 can be adjusted to inhibit noise. First signal component 515 may comprise first pulses 760 of a delta sigma pulse width modulation component as described above. The intensity of the first signal component can be adjusted, for example decreased so as to comprise an intensity adjusted signal 515A comprising intensity adjusted pulses 770. First signal component 515 has a first optical intensity 762 and a first width 764, for example a first time width. Intensity adjusted signal 515A has a second optical intensity 776, which is less than the first optical intensity by an amount 774. The corresponding energy of each pulse is decreased. The energy of each light pulse corresponds to the energy per unit time, or power, multiplied by the duration, or width, of the pulse. Each of the adjusted pulses of adjusted signal 515A comprises intensity 776, such that the intensity of the pulses are similarly adjusted relative to the pulses of the second signal component 525.

Figure 7B:
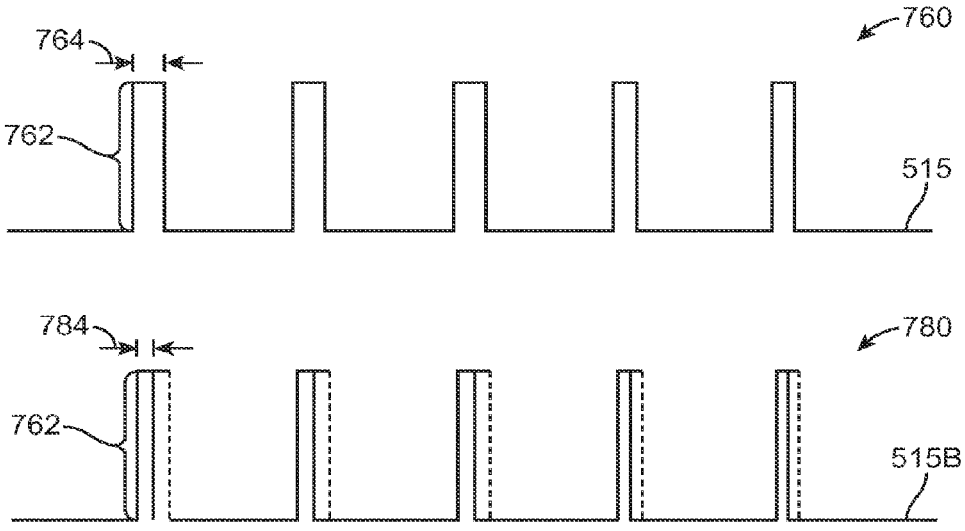
FIG. 7B shows adjusted pulse widths of the signals with circuitry as in FIG. 7.

FIG. 7B shows adjusted pulse widths of the signals with circuitry as in FIG. 7. The widths of the pulses of the first signal component 515 can be adjusted relative to the widths of the second signal component 525 so as to adjust the energy of the pulses of the first signal component relative to the energy of the pulses of the second signal component, such that noise is inhibited. First signal component 515 comprises a pulse having first intensity 762 and first width 764, such that the energy of the pulse is related to the product of the pulse intensity and duration of the pulse. The width of the first signal component can be adjusted, for example decreased so as to comprise a width adjusted signal 515B comprising width adjusted pulses 780. Width adjusted signal 515B has a second pulse width 784, which is less than the first pulse width by an amount. The widths of each of the pulses of the width adjusted signal 515B can be similarly adjusted such that the corresponding energy of each pulse is decreased. For example, to decrease the relative intensity of each of the width adjusted pulses, the width of each pulse can be decreased by a proportional amount, for example a 10% decrease in the width of each pulse. Each of the width adjusted pulses can be similarly adjusted, such that the energy of each of the pulses are similarly adjusted relative to the pulses of the second signal component 525.

Figure 7C:
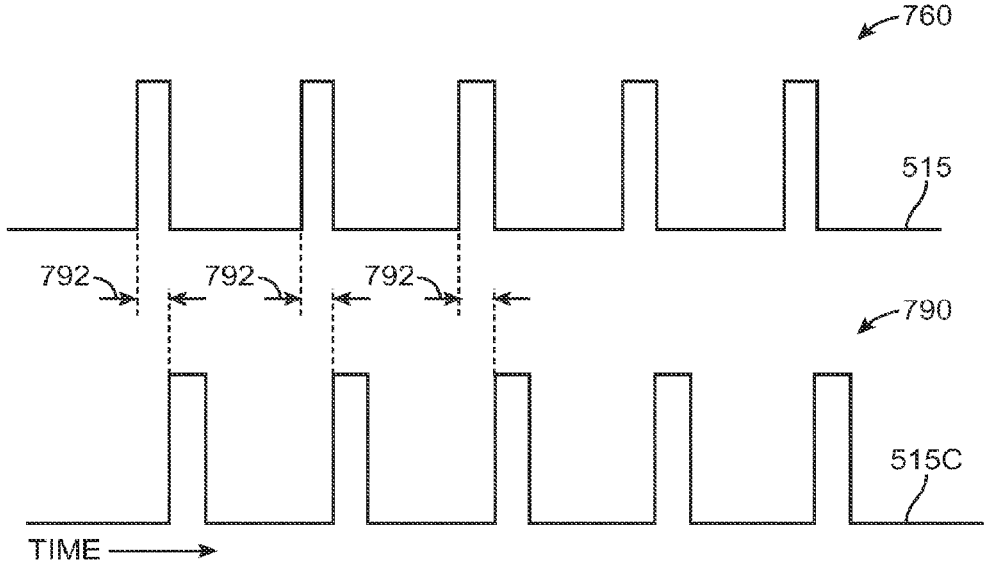
FIG. 7C shows adjusted timing of the signals with circuitry as in FIG. 7.

FIG. 7C shows adjusted timing of the signals with circuitry as in FIG. 7. Each of the pulses 760 of the first signal component can be delayed by an amount 792, so as to correct for the first detector having the first delay an the second detector having the second delay, in which the first delay is different from the second delay. For example, the first detector can be faster than the second detector by an amount 792, and the first pulses delayed by amount 792 to inhibit the noise. The time adjusted signal 515C comprises time adjusted pulses 790, such that the first signal is delayed relative to second signal component 525.

The pulses can be adjusted in many ways to inhibit the noise. For example the pulses can be adjusted in both timing and energy to inhibit the noise. Also, both the width and the intensity of the pulses can be adjusted.

Figure 8:
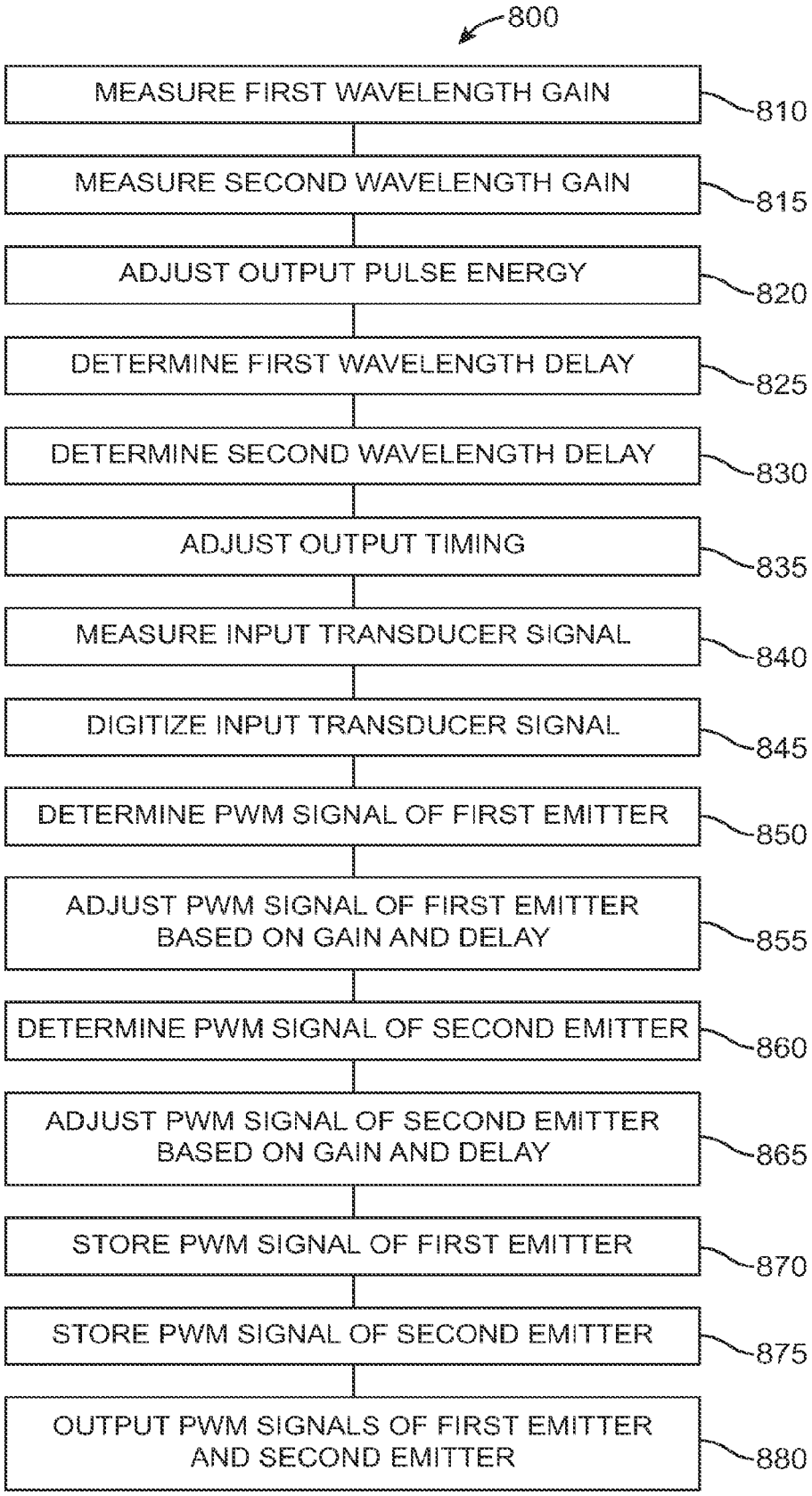
FIG. 8 shows a method of transmitting audio signals to an ear of a user, according to embodiments of the present invention.

FIG. 8 shows a method 800 of transmitting audio signals to an ear of a user. A step 810 determines, for example measures, a first wavelength gain. The first wavelength gain may correspond to one or more of the efficiency of the first emitter, the efficiency of the optical coupling of the first emitter to the first detector, and the sensitivity of the first detector. A step 815 determines, for example measures, a second wavelength gain. The second wavelength gain may correspond to one or more of the efficiency of the second emitter, the efficiency of the optical coupling of the second emitter to the second detector, and the sensitivity of the second detector. A step 820 adjusts the output energy of the pulses, for example one or more of an intensity or widths as described above. A step 825 determines a first wavelength delay. The first wavelength delay may comprise one or more of a delay of the first emitter, a delay of the first detector or a delay of the transducer in the first direction. A step 830 determines a second wavelength delay. The second wavelength delay may comprise one or more of a delay of the first emitter, a delay of the second detector or a delay of the transducer. The gains and delays can be measured in many ways by one of ordinary skill in the art. A step 835 adjusts the output timing. The output timing may be adjusted with a parameter of the audio processor, as described above. The timing may also be adjusted with a buffer external to the audio processor.

The adjusted timing and energy can be used with pulse width modulation as described above. A step 840 measures an input transducer signal. A step 845 digitizes the input transducer signal. A step 850 determines a first pulse width modulation signal of the first emitter. A step 855 adjusts the energy of the pulses of the first pulse width modulation signal based on the first gain and the first delay. A step 860 determines a second pulse width modulation signal of the second emitter. A step 865 adjusts the energy of the pulses of the second pulse width modulation signal based on the second gain and the second delay. A step 870 stores the adjusted pulse width modulation signal of the first emitter in a first buffer. A step 875 stores the adjusted pulse width modulation signal of the second emitter in a second buffer. A step 880 outputs the adjusted pulse width modulation signals from the buffers to the first emitter and the second emitter.

Method 800 can be implemented with many devices configured to transmit sound to a user, for example with at least two electrodes as described above. For example, at least one photodetector can be coupled to at least two electrodes positioned in the cochlea so as to stimulate the cochlea in response to the emitted light and such that the user perceives sound.

Many of the steps of method 800 can be implemented with the audio processor, described above. For example, the tangible medium of the audio processor may comprise instructions of a computer program embodied therein to implement many of the steps of method 800.

It should be appreciated that the specific steps illustrated in FIG. 8 provides a particular method transmitting an audio signal, according to some embodiments of the present invention. Other sequences of steps may also be performed according to alternative embodiments. For example, alternative embodiments of the present invention may perform the steps outlined above in a different order. Moreover, the individual steps illustrated in FIG. 8 may include multiple sub-steps that may be performed in various sequences as appropriate to the individual step. Furthermore, additional steps may be added or removed depending on the particular applications. One of ordinary skill in the art would recognize many variations, modifications, and alternatives.

While the above is a complete description of the preferred embodiments of the invention, various alternatives, modifications, and equivalents may be used. Therefore, the above description should not be taken as limiting in scope of the invention which is defined by the appended claims.

What is claimed is:

1. A device to transmit an audio signal to a user, the device comprising:

a first light source configured to emit a first at least one wavelength of light; a second light source configured to emit a second at least one wavelength of light; a transducer assembly comprising at least one light responsive material configured to vibrate at least one of an eardrum, an ossicle, or a cochlea of the user;

circuitry coupled to the first light source to emit first light pulses and to the second light source to emit second light pulses and wherein the circuitry is configured to adjust at least one of an energy or a timing of the first light pulses relative to the second light pulses to decrease noise of the audio signal transmitted to the user.

2. The device of claim 1 wherein the circuitry is configured to adjust at least one of an energy or a timing of the first light pulses relative to the second light pulses to increase output of the audio signal transmitted to the user when the noise is decreased.

3. The device of claim 1 wherein the transducer assembly is configured to move in a first direction in response to the first light pulses and move a second direction opposite the first direction in response the second light pulses.

4. The device of claim 3 wherein the circuitry is configured to adjust the timing of the first pulses relative to the second pulses.

5. The device of claim 4 wherein the transducer assembly is configured to move in the first direction with a first delay in response to each of the first light pulses and configured to move in the second direction with a second delay in response to each of the second light pulses, the first delay different from the second delay.

6. The device of claim 5 wherein the circuitry is configured to adjust the timing to inhibit noise corresponding to the first delay different from the second delay.

7. The device of claim 6 wherein the transducer assembly comprises a first detector and a second detector, wherein the first detector comprises a silicon detector and the second detector comprises an InGaAs detector and wherein a difference between the first delay and the second delay is within a range from about 100 ns to about 10 us.

8. The device of claim 3 wherein the circuitry comprises a buffer configured to store the first signal to delay the first signal.

9. The device of claim 3 wherein the circuitry comprises filter circuitry comprising at least one of an inductor, a capacitor or a resistor to delay the first signal.

10. The device of claim 3 wherein the circuitry is configured to adjust first energies of the first light pulses relative to second energies of the light second pulses to inhibit the noise.

11. A method of transmitting an audio signal to a user, the method comprising:

emitting first pulses comprising a first at least one wavelength of light from a first light source;

emitting second pulses comprising a second at least one wavelength of light from a second light source; and receiving the first pulses and the second pulses with a transducer assembly to vibrate at least one of an eardrum, an ossicle, or a cochlea of the user, wherein at least one of an energy or a timing of the first pulses is adjusted relative to the second pulses to decrease noise of the audio signal transmitted to the user.

12. The method of claim 11 wherein the circuitry adjusts the at least one of the energy or the timing of the first light pulses relative to the second light pulses to increase output of the audio signal transmitted to the user when the noise is decreased.

13. The method of claim 11 wherein the transducer assembly is moved in a first direction in response to the first pulses and moved in a second direction in response to the second pulses, the second direction opposite the first direction.

14. The method of claim 13 wherein the timing of the first pulses is adjusted relative to the second pulses.

15. The method of claim 14 wherein the transducer assembly moves in the first direction with a first delay in response to each of the first pulses and moves in the second direction with a second delay in response to each of the second pulses, the second delay different from the first delay.

16. The method of claim 15 wherein the timing is adjusted to inhibit noise corresponding to the first delay different from the second delay.

17. The method of claim 15 wherein the transducer assembly comprises a first detector and a second detector, wherein the first detector comprises a silicon detector and the second detector comprises an InGaAs detector and wherein a difference between the first delay and the second delay is within a range from about 100 ns to about 10 us.

18. The method of claim 13 wherein first energies of the first light pulses are adjusted relative to second energies of the second light pulses to inhibit the noise.

19. The method of claim 18 wherein a first intensity of the first pulses is adjusted relative to a second intensity of the second pulses to inhibit the noise.

20. The method of claim 18 wherein first widths of the first pulses is adjusted relative to second widths of the second pulses to inhibit the noise.

* * * * *